US009100745B2

(12) United States Patent
Oishi

(10) Patent No.: US 9,100,745 B2
(45) Date of Patent: Aug. 4, 2015

(54) MODULAR AUDIO DEVICES CONFIGURED TO EMIT DIFFERING SOUND PROFILES AND RELATED METHODS

(71) Applicant: Skullcandy, Inc., Park City, UT (US)

(72) Inventor: Tetsuro Oishi, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 332 days.

(21) Appl. No.: 13/732,193

(22) Filed: Dec. 31, 2012

(65) Prior Publication Data

US 2013/0177165 A1 Jul. 11, 2013

Related U.S. Application Data

(60) Provisional application No. 61/584,660, filed on Jan. 9, 2012.

(51) Int. Cl.
*H04R 1/10* (2006.01)
*H04S 7/00* (2006.01)

(52) U.S. Cl.
CPC ..... *H04R 1/1041* (2013.01); *H04R 1/1008* (2013.01); *H04R 2201/023* (2013.01); *H04S 7/30* (2013.01); *H04S 2400/15* (2013.01)

(58) Field of Classification Search
None
See application file for complete search history.

(56) References Cited

U.S. PATENT DOCUMENTS

| | | | | |
|---|---|---|---|---|
| 1,418,388 | A | 6/1922 | Miessner | |
| 3,938,614 | A | 2/1976 | Ahs | |
| 5,551,089 | A | 9/1996 | Whidden | |
| 5,625,903 | A | 5/1997 | Schultz et al. | |
| 6,466,681 | B1 * | 10/2002 | Siska et al. | 381/372 |
| 6,546,264 | B1 * | 4/2003 | Kennedy | 455/575.2 |
| 7,187,948 | B2 | 3/2007 | Alden | |
| 7,245,736 | B2 | 7/2007 | Tsunoda et al. | |
| 7,388,960 | B2 | 6/2008 | Kuo et al. | |
| 7,395,090 | B2 | 7/2008 | Alden | |
| D623,627 | S | 9/2010 | Alden et al. | |
| D624,057 | S | 9/2010 | Kelly et al. | |

(Continued)

FOREIGN PATENT DOCUMENTS

| | | | |
|---|---|---|---|
| CA | 2515558 | A1 | 2/2007 |
| CA | 2697029 | A1 | 2/2007 |

(Continued)

OTHER PUBLICATIONS

International Search Report on PCT/US2009/065926, mailed Jul. 9, 2010.

(Continued)

*Primary Examiner* — Brenda Bernardi
(74) *Attorney, Agent, or Firm* — TraskBritt

(57) ABSTRACT

Modular audio headphone devices comprise a first user-wearable accessory and at least one headphone configured for releasable attachment to the first user-wearable accessory. The at least one headphone comprises a speaker. A speaker housing is coupled to the speaker and may be configured to form an acoustic cavity proximate at least a portion of the speaker. The at least one headphone may be configured to provide a first emitted sound pressure level (SPL) profile over a range of frequencies when the at least one headphone is attached to the first user-wearable accessory, and to provide a different second emitted SPL profile over the range of frequencies when the at least one headphone is not attached to the first user-wearable accessory.

20 Claims, 15 Drawing Sheets

(56) References Cited

U.S. PATENT DOCUMENTS

| | | | |
|---|---|---|---|
| 7,869,608 | B2 | 1/2011 | Sander et al. |
| D641,003 | S | 7/2011 | Alden |
| 8,014,824 | B2 | 9/2011 | Alden |
| D650,356 | S | 12/2011 | Alden et al. |
| D656,129 | S | 3/2012 | Kelly et al. |
| D665,776 | S | 8/2012 | Alden et al. |
| D665,777 | S | 8/2012 | Alden et al. |
| D673,136 | S | 12/2012 | Kelly et al. |
| D673,140 | S | 12/2012 | Kelly et al. |
| D674,372 | S | 1/2013 | Kelly et al. |
| D674,376 | S | 1/2013 | Kelly et al. |
| D676,023 | S | 2/2013 | Kelly et al. |
| D676,024 | S | 2/2013 | Kelly et al. |
| D677,241 | S | 3/2013 | Kelly et al. |
| D683,717 | S | 6/2013 | Kelly et al. |
| 8,457,557 | B2 | 6/2013 | Alden |
| D685,759 | S | 7/2013 | Kelly et al. |
| D685,767 | S | 7/2013 | Kelly et al. |
| 8,515,115 | B2 | 8/2013 | Kelly et al. |
| D689,464 | S | 9/2013 | Bonahoom et al. |
| D691,582 | S | 10/2013 | Nguyen et al. |
| D693,793 | S | 11/2013 | Kelly et al. |
| D699,216 | S | 2/2014 | Bonahoom et al. |
| D701,193 | S | 3/2014 | Kelly et al. |
| D701,196 | S | 3/2014 | Kelly et al. |
| D701,197 | S | 3/2014 | Kelly et al. |
| 2002/0094094 | A1 | 7/2002 | Shin |
| 2003/0007660 | A1 | 1/2003 | Tsunoda et al. |
| 2005/0008184 | A1 | 1/2005 | Ito et al. |
| 2010/0111349 | A1 | 5/2010 | Devlas et al. |
| 2010/0284525 | A1 | 11/2010 | Sander et al. |
| 2011/0235819 | A1 | 9/2011 | Alden |
| 2012/0275615 | A1 | 11/2012 | Kelly et al. |
| 2013/0022227 | A1* | 1/2013 | Wu et al. ..... 381/380 |
| 2013/0118944 | A1 | 5/2013 | Niiro et al. |
| 2013/0130540 | A1 | 5/2013 | Oman et al. |
| 2013/0177165 | A1 | 7/2013 | Oishi |
| 2013/0177195 | A1 | 7/2013 | Sze et al. |
| 2013/0185905 | A1 | 7/2013 | Stiff et al. |
| 2013/0208909 | A1 | 8/2013 | Mülder |
| 2013/0336514 | A1 | 12/2013 | Kelly et al. |
| 2014/0056459 | A1 | 2/2014 | Oishi et al. |

FOREIGN PATENT DOCUMENTS

| | | | |
|---|---|---|---|
| EP | 1760896 | A1 | 3/2007 |
| EP | 2262117 | A1 | 12/2010 |
| KR | 200220309 | | 4/2001 |
| KR | 20020052658 | | 9/2003 |
| KR | 20040065582 | | 7/2004 |
| KR | 100631863 | | 10/2006 |
| WO | 03053096 | | 12/2002 |
| WO | 2010068495 | A2 | 6/2010 |
| WO | 2010124190 | A2 | 10/2010 |
| WO | 2011085096 | A2 | 7/2011 |
| WO | 2012024656 | A2 | 2/2012 |

OTHER PUBLICATIONS

Opinion of the International Searching Authority on PCT/US2009/065926, mailed Jul. 9, 2010.

Kelly et al.; U.S. Appl. No. 61/502,240, filed Jun. 28, 2011.

* cited by examiner

MODULAR AUDIO DEVICES CONFIGURED TO EMIT DIFFERING SOUND PROFILES AND RELATED METHODS

CROSS-REFERENCE TO RELATED APPLICATIONS

This application claims the benefit of the filing date of U.S. Provisional Patent Application Ser. No. 61/584,660, filed Jan. 9, 2012, for "MODULAR AUDIO DEVICES CONFIGURED TO EMIT DIFFERING SOUND PROFILES AND RELATED METHODS," the disclosure of which is incorporated herein in its entirety by this reference. The subject matter of this application is related to the subject matter of U.S. patent application Ser. No. 13/451,299, filed Apr. 19, 2012, for "MODULAR AUDIO SYSTEMS AND RELATED ASSEMBLIES AND METHODS," the disclosure of which is incorporated herein in its entirety by this reference.

FIELD

The disclosure relates generally to modular audio headphone devices having improved acoustic characteristics. More specifically, disclosed embodiments relate to modular audio headphone devices including headphones exhibiting differing output sound characteristics when used with different accessories, which may result in more consistent detectable or detected sound characteristics to a user when used with the different accessories.

BACKGROUND

Conventional portable audio systems often include a pair of headphones that are connected to a media player (e.g., by one or more wires or by wireless technology). Recently, modular headphones have been developed that may be attached to a headband and used in a conventional manner by wearing the headband with the headphones attached thereto on the head, as well as by removing the headphones from the headband and mounting or otherwise attaching them to another user-wearable accessory or clothing, such as a skull cap, goggles, a helmet, a hooded sweatshirt, etc. Such modular headphones are disclosed in, for example, U.S. Patent Application Pub. No. 2011/0235819, published Sep. 29, 2011, now U.S. Pat. No. 8,542,859, issued Sep. 24, 2013, to Alden, the disclosure of which is incorporated herein in its entirety by this reference.

BRIEF SUMMARY

In some embodiments, modular audio headphone devices comprise a first user-wearable accessory and at least one headphone configured for releasable attachment to the first user-wearable accessory. The at least one headphone comprises a speaker. A speaker housing is coupled to the speaker and configured to form an acoustic cavity proximate at least a portion of the speaker. The at least one headphone is configured to provide a first emitted sound pressure level (SPL) profile over a range of frequencies when the at least one headphone is attached to the first user-wearable accessory, and to provide a different second emitted SPL profile over the range of frequencies when the at least one headphone is not attached to the first user-wearable accessory.

In other embodiments, modular audio headphone devices comprise at least one headphone configured for releasable attachment to a first user-wearable accessory. The at least one headphone comprises a speaker. A speaker housing is coupled to the speaker. A first ear pad is configured for attachment to the at least one headphone. A second ear pad is configured for attachment to the at least one headphone. The second ear pad is different from the first ear pad. The first ear pad is configured to attenuate an emitted SPL profile emitted by the at least one headphone over a range of frequencies to provide a first detectable SPL profile over the range of frequencies to a user of the modular audio headphone device when the first ear pad is attached to the at least one headphone and the at least one headphone is attached to a first user-wearable accessory worn by the user. The second ear pad is configured to attenuate the emitted SPL profile emitted by the at least one headphone over the range of frequencies to provide a second detectable SPL profile over the range of frequencies to the user of the modular audio headphone device when the second ear pad is attached to the at least one headphone and the at least one headphone is attached to a second user-wearable accessory worn by the user. The second detectable SPL profile is at least substantially similar to the first detectable SPL profile over the range of frequencies.

In other embodiments, modular audio headphone devices comprise at least one headphone configured for releasable attachment to a first user-wearable accessory. The at least one headphone comprises a speaker and a speaker housing coupled to the speaker. A reversible ear pad is configured for attachment to the at least one headphone. The reversible ear pad is configured to alter an emitted SPL profile emitted by the at least one headphone over a range of frequencies to provide a first detectable SPL profile over the range of frequencies to a user of the modular audio headphone device when the reversible ear pad is attached to the at least one headphone in a first orientation and the at least one headphone is attached to the first user-wearable accessory worn by the user. The reversible ear pad is configured to alter the emitted SPL profile emitted by the at least one headphone over the range of frequencies to provide a second detectable SPL profile over the range of frequencies to the user of the modular audio headphone device when the reversible ear pad is attached to the at least one headphone in a second, opposite orientation and the at least one headphone is attached to a second user-wearable accessory worn by the user. The second detectable SPL profile is at least substantially similar to the first detectable SPL profile over the range of frequencies.

In still other embodiments, methods of making modular audio headphone devices comprise forming at least one headphone comprising a speaker and a speaker housing coupled to the speaker and configured to form an acoustic cavity proximate at least a portion of the speaker. The at least one headphone is configured for releasable attachment to a first user-wearable accessory. The at least one headphone is configured to emit a first sound pressure level (SPL) profile over a range of frequencies when the at least one headphone is attached to the first user-wearable accessory and to emit a second, different SPL profile over the range of frequencies when the at least one headphone is not attached to the first user-wearable accessory.

In yet other embodiments, methods of designing modular audio headphone devices comprise configuring at least one headphone to emit a first sound pressure level (SPL) profile over a range of frequencies when the at least one headphone is attached to a first user-wearable accessory, the at least one headphone configured for releasable attachment to the first user-wearable accessory and comprising a speaker and a speaker housing coupled to the speaker and configured to form an acoustic cavity proximate at least a portion of the speaker. The at least one headphone is configured to emit a second, different SPL profile over the range of frequencies when the at least one headphone is not attached to the first user-wearable accessory.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

Figure 1:
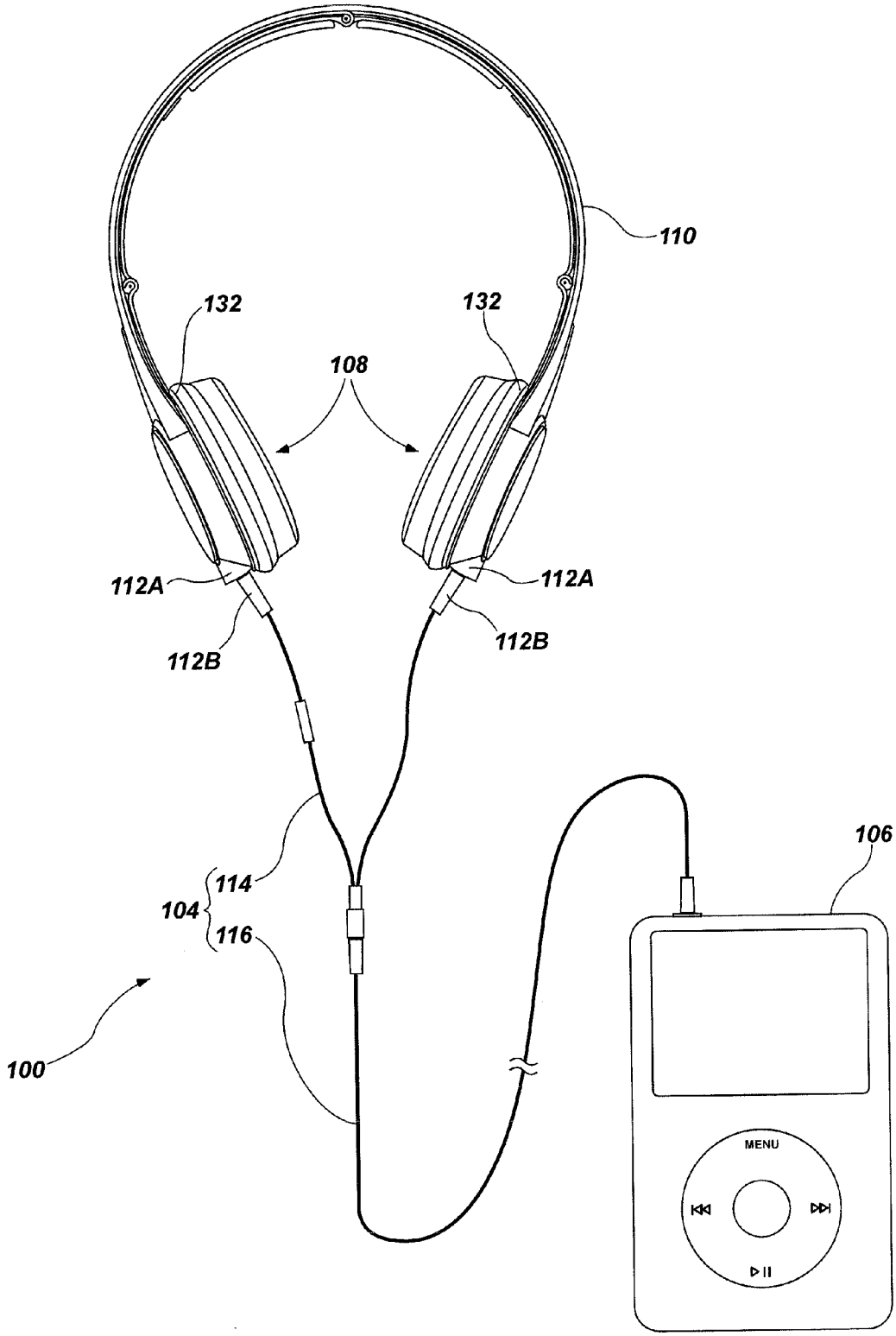
FIG. 1 is a front view of a modular audio headphone device configured for use with a user-wearable accessory comprising a headband.

The illustrations presented herein are not meant to be actual views of any particular audio device or component thereof, but are merely idealized representations employed to describe illustrative embodiments. Thus, the drawings are not necessarily to scale.

As used herein, the term "media player" means and includes any device or system capable of producing an audio signal and connectable to a speaker to convert the audio signal to audible sound. For example, media players include portable digital music players, portable CD players, portable cassette players, mobile phones, smartphones, personal digital assistants (PDAs), radios (e.g., AM, FM, HD, and satellite radios), ebook readers, portable gaming systems, portable DVD players, laptop computers, tablet computers, desktop computers, stereo systems, etc.

As used herein, the term "audio jack" means and includes any connector through which an audio signal (e.g., an analog audio signal) is transmittable and which is used to repeatedly structurally and electrically connect and disconnect components of an audio system relative to one another. For example, audio jacks may be male or female (e.g., plugs or sockets) and may include tip, ring, sleeve (TRS) connectors; tip, sleeve (TS) connectors; tip, ring, ring, sleeve (TRRS) connectors; stereo plugs; mini-jacks; mini-stereo connectors; headphone jacks; and Bantam plugs.

As used herein, the term "emitted sound pressure level (SPL) profile" means and includes sound pressure levels over a range of frequencies, as measured in dB (SPL) per 1 mW, of audio signals as emitted by a sound source (e.g., a speaker).

As used herein, the term "detectable sound pressure level (SPL) profile" means and includes sound pressure levels over a range of frequencies of audio signals as detectable or detected by a user of modular audio headphone device, as measured in dB (SPL) per 1 mW. Detectable SPL profiles may be measured using commercially available testing equipment and software. For example, detectable SPL profiles may be obtained using, for example, the Head and Torso Simulator ("HATS") Type 4128C and Ear Part Number 4158-C commercially available from Brüel & Kjær Sound & Vibration Measurement A/S of Nerum, Denmark, in conjunction with sound test and measurement software, such as SOUND-CHECK® 10.1, which is commercially available from Listen, Inc. of Boston, Mass.

Embodiments of the present disclosure include modular headphone devices that include headphones that can be carried by more than one accessory, wherein the sound characteristics of the headphones are adjusted, either mechanically or electronically, at least substantially automatically as the headphone is either engaged with an accessory or disengaged from an accessory. As a result, the headphones may be operable in at least two different states or configurations, one of which may be tuned for use of the headphone with one accessory, and another of which may be tuned for use of the headphone with another accessory. In some embodiments, the at least two different states or configurations may be selectively tuned to provide an at least substantially similar sound profile over at least a range of audible frequencies, such that the headphones provide a generally similar sound to the user when used with different accessories.

Referring to FIG. 1, a front view of a modular audio headphone device 100 is shown. The modular audio headphone device 100 may include two headphones 108 and a wiring system 104. As shown in FIG. 1, the modular audio headphone device 100 may be used with a media player 106. The headphones 108 may comprise on-ear headphones as shown. In additional embodiments, they may comprise over-ear headphones. Each headphone 108 is connected to the wiring system 104, and the wiring system 104 is connected to the media player 106 such that an audio signal from the media player 106 may be transmitted through the wiring system 104 to the headphones 108 where it is converted to audible sound.

The modular audio headphone device 100 may further include one or more accessories with which the headphones 108 may be used. For example, the modular audio headphone device 100 may include a user-wearable accessory, such as the headband 110 shown in FIG. 1. The headband 110 may be configured to rest on a user's head and to support the two headphones 108 when in use. In other embodiments, the headband 110 may be configured to rest on a user's ears and extend around a back of the head of the user while supporting the two headphones 108. The headband 110 may be configured to position the two headphones 108 attached to the headband 110 proximate (e.g., over) the ears of a user. Additional detail regarding the headband 110 is provided below with reference to FIGS. 11 through 13.

The headphones 108 may be detachably connected to the wiring system 104. For example, each headphone 108 may comprise an audio jack 112A that may be detachably connected to an audio jack 112B of the wiring system. As a specific, non-limiting example, the audio jack 112A of each headphone 108 may comprise a female TRS connector (e.g., a jack socket) connected to an audio jack 112B of the wiring system 104 comprising a male TRS connector (e.g., jack plug). In some embodiments, the audio jack 112A of each headphone 108 may be integral to the headphone 108. In other words, there may not be any external wires permanently connected to the headphone 108 connecting the audio jack 112A to the headphone 108. In other embodiments, the audio jack 112A of each headphone 108 may be separate from the headphone 108 and connected thereto by a wire. In yet further embodiments, the headphones 108 may be permanently connected to the wiring system 104 and may not include audio jacks 112A and 112B for each respective headphone 108.

The headphones 108 may be removably attached to the headband 110. In other words, the headphones 108 and the headband 110 may be respectively configured to allow the headphones 108 to be repeatedly attached to, and detached from, the headband 110 by a user without causing damage to the headphones 108 or the headband 110. In this configuration, the headphones 108 may be detachable from both the wiring system 104 and the headband 110 and connectable to, or installable in, another accessory for use with that other accessory. Accordingly, the headphones 108 may be easily removed from one accessory (e.g., the headband 110) and employed with another accessory (e.g., a user-wearable accessory such as a hood of a sweater or a skull cap, or an accessory such as a docking station), such that the set of headphones 108 is usable with a variety of accessories in a variety of different ways and environments. Additional detail regarding the headphones 108 is discussed herein below with reference to FIGS. 8, 9, 13, and 14.

In some embodiments, the wiring system 104 may comprise separate wiring assemblies 114 and 116 that may be interconnected to one another to provide an audio signal path between the headphones 108 and the media player 106. In other embodiments, the wiring system 104 may comprise a single, unitary wiring assembly. For example, suitable wiring systems are disclosed in the aforementioned U.S. Patent Application Pub. No. 2011/0235819, published Sep. 29, 2011, to Alden, and U.S. patent application Ser. No. 13/451,299, filed Apr. 19, 2012, for "MODULAR AUDIO SYSTEMS AND RELATED ASSEMBLIES AND METHODS."

Figure 2:
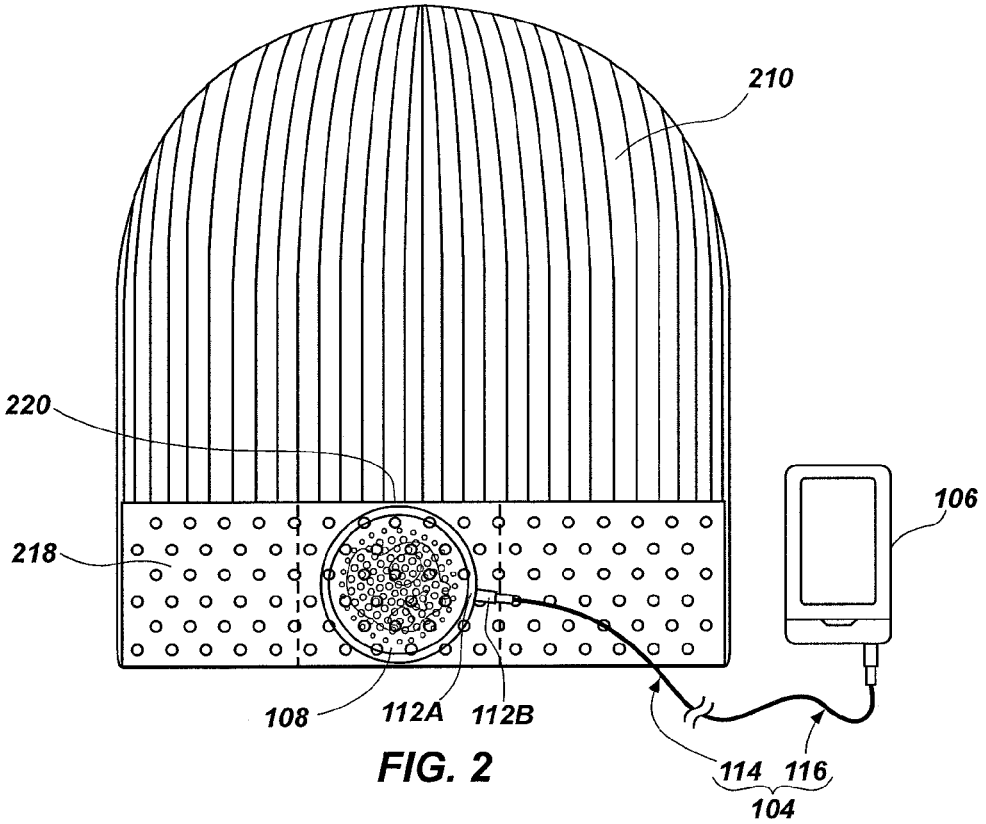
FIG. 2 is a simplified and schematically illustrated side interior view of a modular audio headphone device configured for use with another user-wearable accessory comprising a skull cap.
Figure 3:
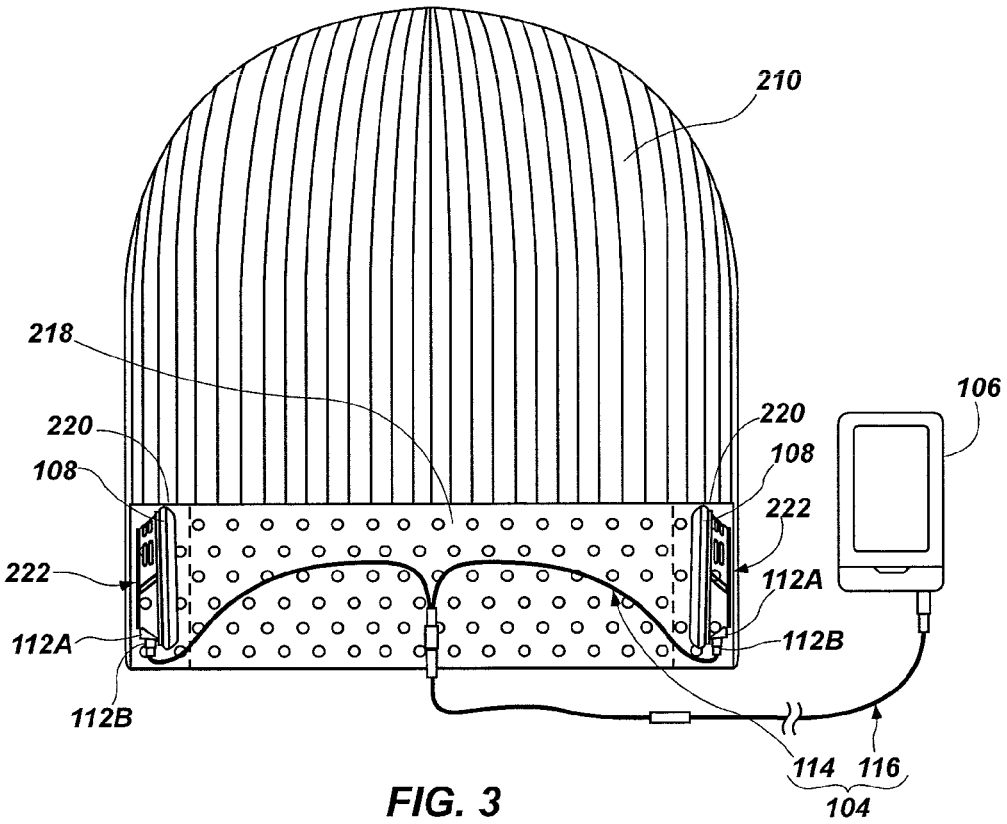
FIG. 3 is similar to FIG. 2, but is a front interior view illustrating the skull cap and headphones carried therein from a perspective rotated ninety degrees from the perspective of FIG. 2.

FIGS. 2 and 3 are interior views of the modular audio headphone device 100 being used with another user wearable accessory comprising a knitted skull cap 210 instead of the headband 110 (FIG. 1). As non-limiting examples, other user-wearable accessories with which the modular audio headphone device 100 may be used include other types of hats (e.g., a baseball-style cap with a brim and ear coverings, a "bomber" style hat, a winter hat, or any known hat including or altered to include an ear covering) and hoods (such as the hood of a sweatshirt).

With continued reference to FIGS. 2 and 3, the skull cap 210 and the headphones 108 may be configured to allow placement of the headphones 108 securely within the skull cap 210. For example, a liner 218 configured to receive headphones 108 therein may be provided on an inner portion of the skull cap 210. Such a liner 218 may be sewn, adhered, attached with hook and loop fastener material (e.g., VELCRO®), or attached with a zipper or zippers to the interior of the skull cap 210. The liner 218 may extend entirely around the skull cap 210 in some embodiments. In other embodiments, the liner 218 may extend from a first side of the skull cap 210, around a back of the skull cap 210, to a second, opposing side of the skull cap 210. In yet further embodiments, two liners 218 may be disposed on the first and second, opposing sides of the skull cap 210. The first and second, opposing sides of the skull cap 210 lined by the liner 218 may be located proximate the ears of a user when the user is wearing the skull cap 210. The liner 218 may comprise a fabric, which may be the same as a fabric of the skull cap 210 or different from the fabric of the skull cap 210. For example, the liner 218 may comprise a mesh, a synthetic fiber fabric, a natural fiber fabric, a knit fabric, or a woven fabric.

Referring specifically to FIG. 3, an interior rear of the skull cap 210 is shown. The headphones 108 may be disposed in the liner 218 on the first and second, opposing sides of the skull cap 210. For example, openings 220 may be formed in the liner 218 and the headphones 108 may be inserted through the openings 220 into the liner 218. The headphones 108 may optionally be secured within the liner 218 by closing the openings 220. The liner 218 may include discrete compartments 222 for containing the headphones 108. The headphones 108 may be secured within the liner 218 in some embodiments. In alternative embodiments, the openings 220 may remain open, and gravity and friction may keep the headphones 108 in the liner 218. The liner 218 may include at least one aperture through which the wiring system 104, or at least portions thereof, may pass. Thus, the wiring system 104 may extend from the headphones 108 in the liner 218, out through the liner 218, and to a media player 106 (when in use).

In other embodiments, the skull cap 210 may comprise an opening into and a space between layers of material forming the skull cap 210, and the headphones 108 may be placed into the space between the layers of material through the opening.

As previously mentioned, in accordance with embodiments of the present disclosure, the sound characteristics of the headphones 108 of the modular audio headphone device 100 are adjusted, either mechanically, electronically, or both, at least substantially automatically as the headphone is either engaged with an accessory or disengaged with an accessory, such as the headband 110 of FIG. 1. As a result, the headphones 108 may be operable in at least two different states or configurations, one of which may be tuned for use of the headphones 108 with one accessory, such as the headband 110, and another of which may be tuned for use of the headphones 108 with another accessory, such as the skull cap 210 of FIGS. 2 and 3.

Figure 4:
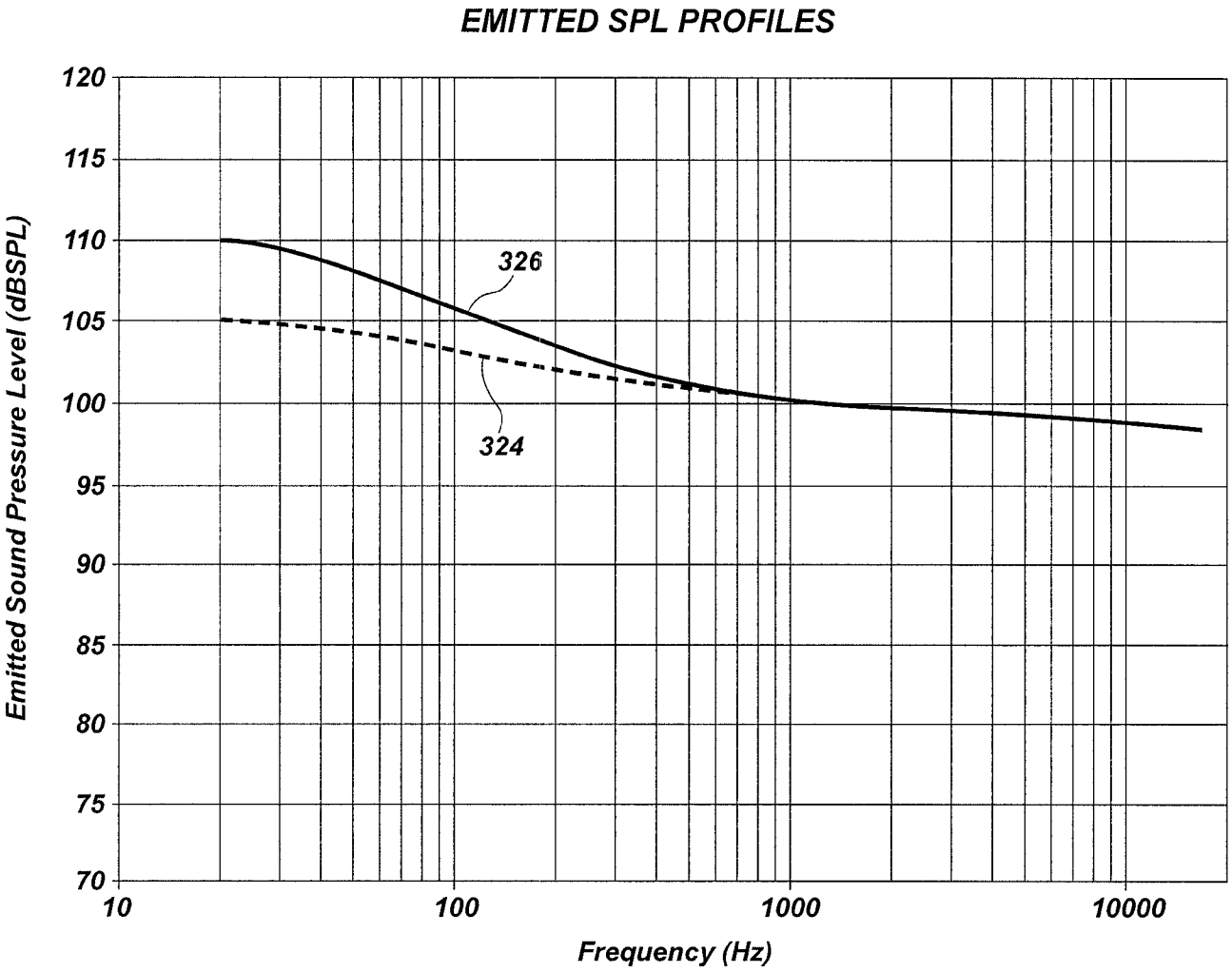
FIG. 4 is a graph of an emitted sound pressure level (SPL) profile that may be exhibited by the modular audio headphone device when connected to an accessory, and a graph of an emitted sound pressure level (SPL) profile with bass boost that may be exhibited by the modular audio headphone devices when disconnected from the accessory.

FIG. 4 is a graph of two different emitted sound pressure level (SPL) profiles that may be exhibited by the modular audio device 100 of FIGS. 1, 2, and 3. When the headphones 108 are connected to the headband 110 (FIG. 1), the headphones 108 may be configured to provide a first emitted SPL profile 324 (represented by the dashed line in FIG. 4) over a range of frequencies. When the headphones 108 are disconnected from the headband 110 (for example, to be carried within the skull cap 210 of FIGS. 2 and 3), the headphones 108 may be configured to automatically provide a second, noticeably different emitted SPL profile 326 (represented by the solid line in FIG. 4) over the same range of frequencies. For example, the second emitted SPL profile 326 may be greater than the first emitted SPL profile 324 over at least some frequencies. In the embodiment of FIG. 4, the second emitted SPL profile 326 is greater than the first emitted SPL profile 324 over low frequencies, thereby illustrating that the headphones 108 may automatically exhibit bass boost when disconnected from the headband 110 relative to when the headphones 108 are connected to the headband 110.

As specific, non-limiting examples, the second emitted SPL profile 326 may be at least about 3 dB (SPL) higher, at least about 5 dB (SPL) higher, or even at least about 7 dB (SPL) higher than the first emitted SPL profile 324 at least at about 60 Hz, and, in some embodiments, over a range of frequencies extending from about 20 Hz to about 100 Hz. Thus, the emitted SPL profile of the headphones 108 may at least substantially automatically adjust upon connection and disconnection of the headphones 108 to and from the headband 110.

Though only two specific SPL profiles 324 and 326 are shown in FIG. 4, the headphones 108 may be configured to at least substantially automatically adjust an emitted SPL profile between more than two operational states, each of which operational states may be selectively tuned for use with a respective accessory (e.g., a headband 110, a skull cap 210, a hood, a helmet, a docking station, etc.).

In some embodiments, the different SPL profiles exhibited by the headphones 108 may be selectively tuned to provide a user of the headphones 108 with a more consistent listening experience when the headphones 108 are used with different accessories, such as with either the headband 110 of FIG. 1 or the skull cap 210 of FIGS. 2 and 3. In other words, the different emitted SPL profiles exhibited by the headphones 108 may be tuned to provide detectable SPL profiles of similar shape when used with different accessories.

Figure 5:
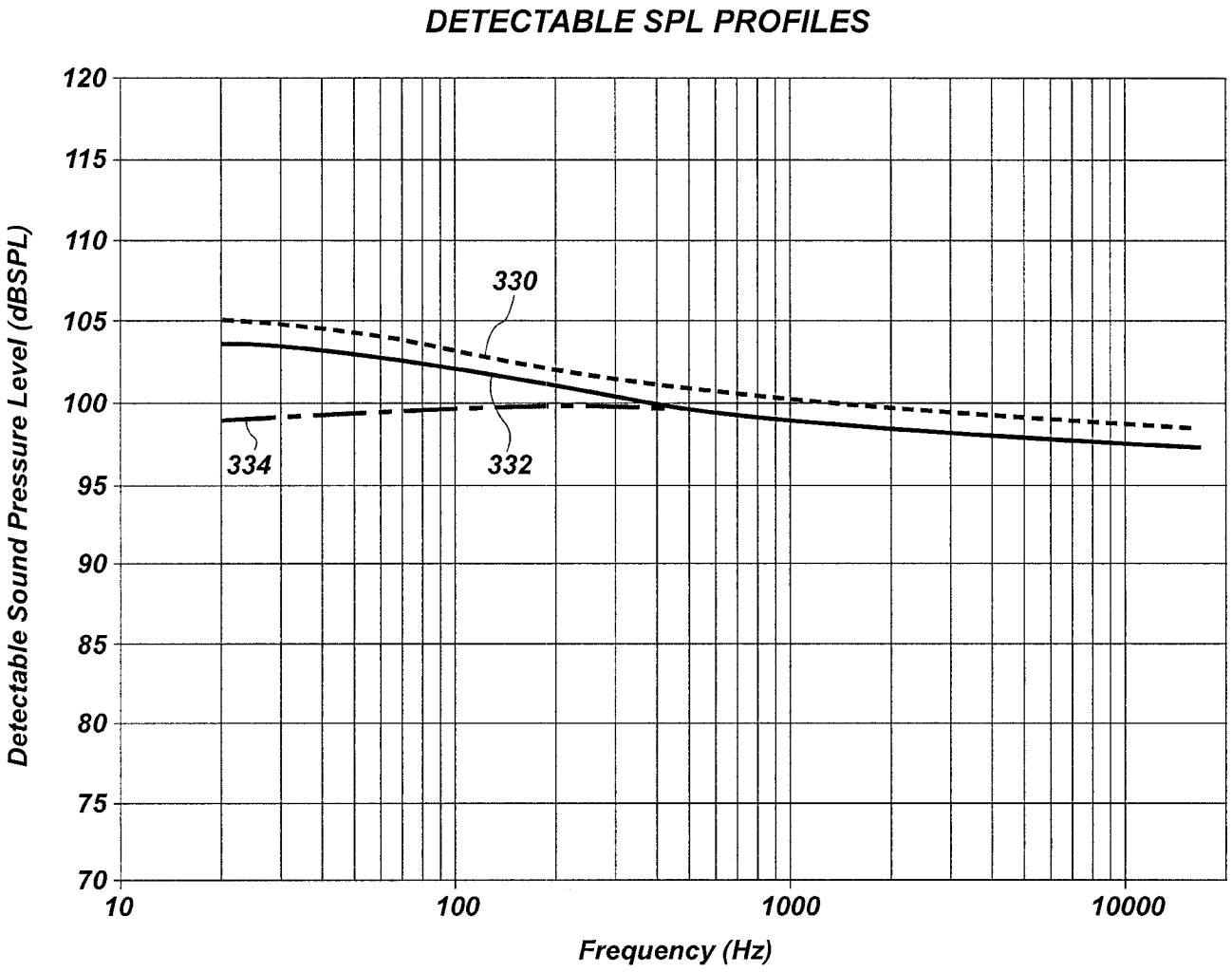
FIG. 5 is a graph of a detectable sound pressure level (SPL) profile that may be exhibited by the modular audio headphone device when connected to an accessory, a graph of a detectable sound pressure level (SPL) profile that may be exhibited by the modular audio headphone device when disconnected from the accessory, and a graph of a detectable sound pressure level (SPL) profile that might be exhibited by the modular audio headphone device if the modular audio headphone device did not include aspects of the present disclosure.

FIG. 5 is a graph of two different detectable SPL profiles 330 and 332 that may be provided by the modular audio headphone device 100 of FIGS. 1, 2, and 3. When the headphones 108 are connected to the headband 110 (FIG. 1) and worn on the head of a user as intended, the headphones 108 may provide a first detectable SPL profile 330 (represented by the dashed line in FIG. 5) over a range of frequencies. When the headphones 108 are disconnected from the headband 110 and carried within the skull cap 210 of FIGS. 2 and 3 on the head of the user, the headphones 108 may provide a second detectable SPL profile 332 (represented by the solid line in FIG. 5) over the same range of frequencies that is generally similar in shape to the first detectable SPL profile 330. For example, the second detectable SPL profile 332 may be within about 7 dB SPL, within about 5 dB SPL, or even within about 3 dB SPL of the first detectable SPL profile 332 when they are normalized with one another over a range of frequencies. Although the absolute values of the detectable SPL profiles 330 and 332 may differ, they may be similar in shape such that the tonal balance remains at least substantially consistent when the headphones 108 are used with different accessories. In the embodiment of FIGS. 4 and 5, the second emitted SPL profile 326 is greater than the first emitted SPL profile 324 (FIG. 4) over low frequencies (representing bass boost), but the second detectable SPL profile 332 (resulting from the second emitted SPL profile 326) is similar to the first detectable SPL profile 330 (resulting from the first emitted SPL profile 324) over the low frequency range (e.g., about 20 Hz to about 100 Hz).

For purposes of illustrating advantages that may be attained through embodiments of the present disclosure, the graph of FIG. 5 also includes a third detectable SPL profile 334 (the dashed-dotted line in FIG. 5), which represents a detectable SPL profile that might be provided to a user by the headphones 108 when carried within the skull cap 210 of FIGS. 2 and 3 on the head of the user if the headphones 108 did not exhibit automatic adjustment of the emitted SPL profile upon disengagement from the headband 110. In other words, if the headphones 108 always exhibited the first emitted SPL profile 324 of FIG. 4, the detectable SPL profile when used with the headband 110 may be as the first detectable SPL profile 330 of FIG. 5, but the detectable SPL profile when used with the skull cap 210 may be as the third detectable SPL profile 334.

In additional embodiments, a first emitted SPL profile exhibited by the headphones 108 may differ from a second emitted SPL profile over a range of frequencies corresponding to high frequency sound (e.g., treble tones). In other words, the headphones 108 may be configured to at least substantially exhibit treble boost when connected to or used with one accessory, but not to exhibit the treble boost when disconnected from the accessory, or when used with another accessory.

Figure 6:
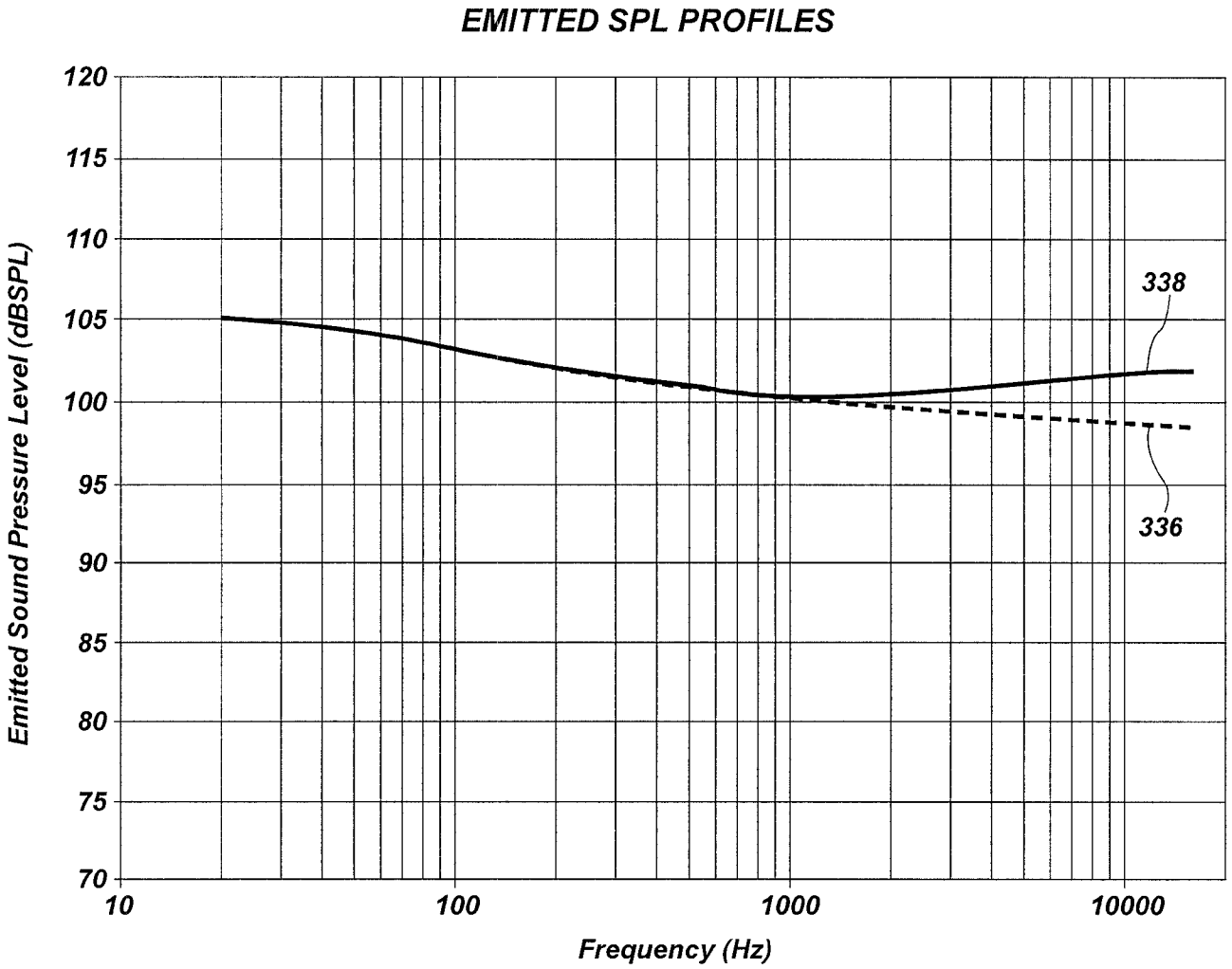
FIG. 6 is a graph of another emitted sound pressure level (SPL) profile that may be exhibited by the modular audio headphone device when used with one accessory, and a graph of an emitted sound pressure level (SPL) profile with treble boost that may be exhibited by the modular audio headphone devices when used with another accessory.

For example, FIG. 6 is a graph of two different emitted sound pressure level (SPL) profiles that may be exhibited by the modular audio device 100 of FIGS. 1, 2, and 3. When the headphones 108 are connected to or used with one accessory, such as the headband 110, the headphones 108 may be configured to provide a first emitted SPL profile 336 (represented by the dashed line in FIG. 6) over a range of frequencies. When the headphones 108 are disconnected from the headband 110 (for example, to be carried within the skull cap 210 of FIGS. 2 and 3), the headphones 108 may be configured to automatically provide a second, noticeably different emitted SPL profile 338 (represented by the solid line in FIG. 6) over the same range of frequencies. For example, the second emitted SPL profile 338 may be greater than the first emitted SPL profile 336 over at least some frequencies. In the embodiment of FIG. 6, the second emitted SPL profile 338 is greater than the first emitted SPL profile 336 over high frequencies, thereby illustrating that the headphones 108 may automatically exhibit treble boost when disconnected from the headband 110 relative to when the headphones 108 are connected to the headband 110.

As specific, non-limiting examples, the second emitted SPL profile 338 may be at least about 3 dB (SPL) higher, at least about 5 dB (SPL) higher, or even at least about 7 dB (SPL) higher than the first emitted SPL profile 324 at least at about 10,000 Hz, and, in some embodiments, over a range of frequencies extending from about 3,000 Hz to about 10,000 Hz. Thus, the emitted SPL profile of the headphones 108 may at least substantially automatically adjust over treble tones (instead of over, or in addition to over bass tones) upon connection and disconnection of the headphones 108 from the headband 110.

As previously mentioned, the headphones 108 may be configured to at least substantially automatically adjust an emitted SPL profile between more than two operational states even though only two specific SPL profiles 336 and 338 are shown in FIG. 6, each of which operational states may be selectively tuned for use with a respective accessory (e.g., a headband 110, a skull cap 210, a hood, a helmet, a docking station, etc.).

Again, the different SPL profiles exhibited by the headphones 108 may be selectively tuned to provide a user of the headphones 108 with a more consistent listening experience when the headphones 108 are used with different accessories, such as with either the headband 110 of FIG. 1 or the skull cap 210 of FIGS. 2 and 3.

Figure 7:
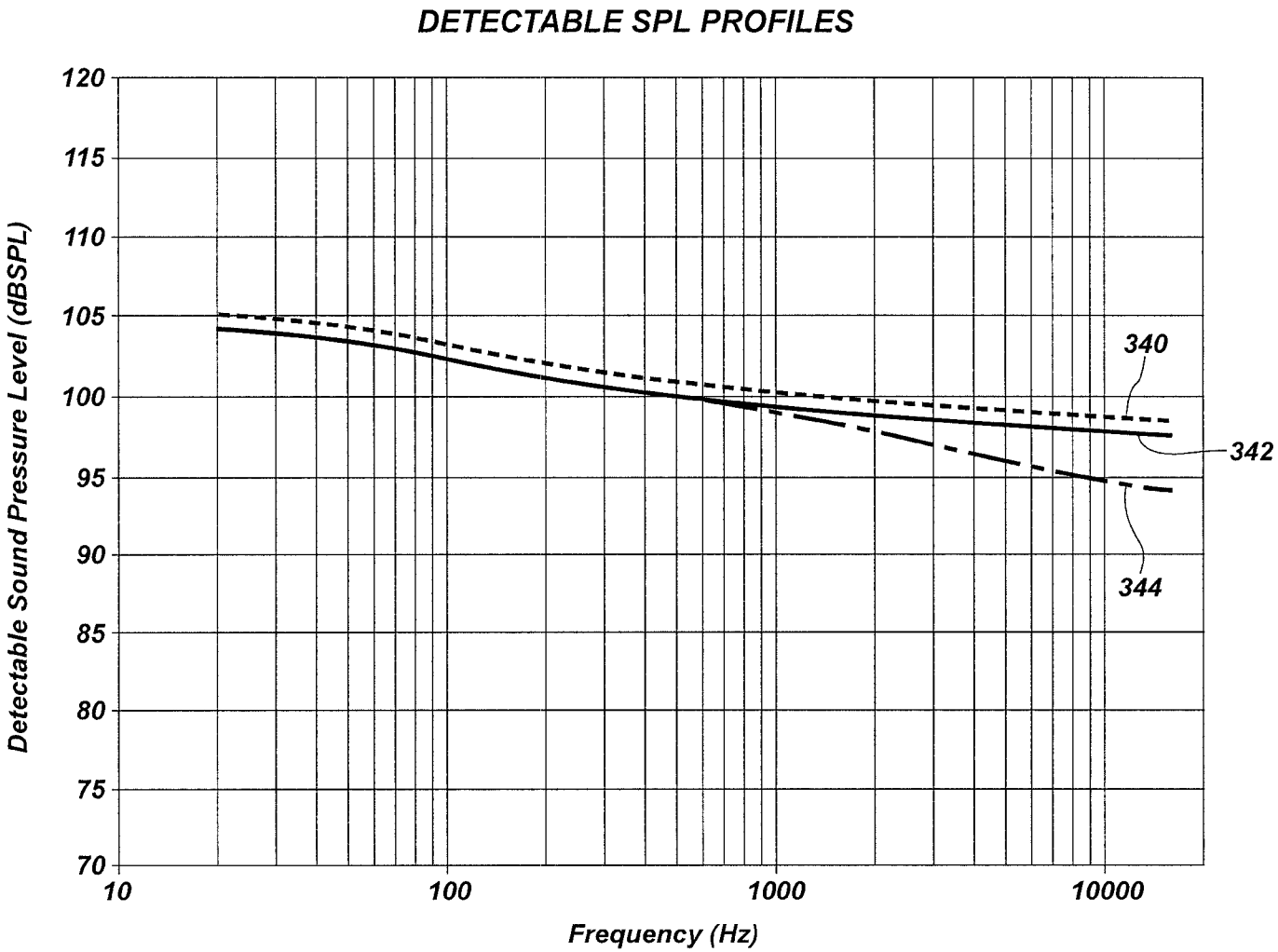
FIG. 7 is a graph of a detectable sound pressure level (SPL) profile that may be exhibited by the modular audio headphone device when used with one accessory, a graph of a detectable sound pressure level (SPL) profile that may be exhibited by the modular audio headphone device when used with another accessory, and a graph of a detectable sound pressure level (SPL) profile that might be exhibited by the modular audio headphone device if the modular audio headphone device did not include aspects of the present disclosure.

FIG. 7 is a graph of two different detectable SPL profiles 340 and 342 that may be provided by the modular audio device 100 of FIGS. 1, 2, and 3. When the headphones 108 are connected to the headband 110 (FIG. 1) and worn on the head of a user as intended, the headphones 108 may provide a first detectable SPL profile 340 (represented by the dashed line in FIG. 7) over a range of frequencies. When the headphones 108 are disconnected from the headband 110 and carried within the skull cap 210 of FIGS. 2 and 3 on the head of the user, the headphones 108 may provide a second detectable SPL profile 342 (represented by the solid line in FIG. 7) over the same range of frequencies that is generally similar in shape to the first detectable SPL profile 340. For example, the second detectable SPL profile 342 may be within about 7 dB SPL, within about 5 dB SPL, or even within about 3 dB SPL of the first detectable SPL profile 340 when they are normalized with one another over a range of frequencies. Although the absolute values of the detectable SPL profiles 340 and 342 may differ, they may be similar in shape such that the tonal balance remains at least substantially consistent when the headphones 108 are used with different accessories. In the embodiment of FIGS. 6 and 7, the second emitted SPL profile 338 is greater than the first emitted SPL profile 336 (FIG. 6) over high frequencies (representing treble boost), but the second detectable SPL profile 342 (resulting from the second emitted SPL profile 338) is similar to the first detectable SPL profile 340 (resulting from the first emitted SPL profile 336) over the high frequency range (e.g., about 3,000 Hz to about 10,000 Hz).

For purposes of illustrating advantages that may be attained through embodiments of the present disclosure, the graph of FIG. 7 also includes a third detectable SPL profile 344 (the dashed-dotted line in FIG. 7), which represents a detectable SPL profile that might be provided to a user by the headphones 108 when carried within the skull cap 210 of FIGS. 2 and 3 on the head of the user if the headphones 108 did not exhibit automatic adjustment of the emitted SPL profile upon disengagement from the headband 110. In other words, if the headphones 108 always exhibited the first emitted SPL profile 336 of FIG. 6, the detectable SPL profile when used with the headband 110 may be as the first detectable SPL profile 340 of FIG. 7, but the detectable SPL profile when used with the skull cap 210 may be as the third detectable SPL profile 344.

In view of the above, by at least substantially automatically altering an emitted SPL profile exhibited by headphones 108 of the modular audio headphone device 100 upon engagement and disengagement of the headphones 108 with an accessory such as the headband 110, or upon use of the headphones 108 with different accessories, a more consistent listening experience may be provided to a user (e.g., by providing detectable SPL profiles of similar shape) compared to the listening experience provided by previously known modular audio headphone devices.

The emitted and detectable SPL profiles shown in FIGS. 4 through 7 are not necessarily actual measured SPL profiles, but rather examples of SPL profiles used to illustrate differing SPL profiles that may be exhibited or provided by headphones when used with different accessories as described herein. Headphones as disclosed and claimed herein may exhibit SPL profiles having different shapes and/or absolute values compared to those illustrated in the figures.

In additional embodiments, a first emitted SPL profile exhibited by the headphones 108 may differ from a second emitted SPL profile exhibited by the headphones 108 over a range or ranges of frequencies corresponding to both low frequency sounds (bass tones) as described above with reference to FIGS. 4 and 5 and high frequency sounds (treble tones) as described above with reference to FIGS. 6 and 7.

In some embodiments, the emitted SPL profiles exhibited by the headphones 108 may be caused to differ from one another through mechanical adjustment.

For example, the emitted SPL profile of a speaker may be affected in low frequencies (e.g., bass tones) through use of a ported acoustical cavity in conjunction with the speaker, and may be varied by adjusting a size of the acoustical cavity and/or a size of the effective cross-sectional port area of the port. Thus, referring again to FIG. 1, in some embodiments, each of the headphones 108 may comprise a ported cavity, and engagement and disengagement of the headphones 108 may adjust the effective size of a port opening for each of the headphones 108. More specifically, surfaces 132 on the headband 110 may cover or partially cover port openings in surfaces of the headphones 108 that abut against the surfaces 132 when the headphones 108 are engaged with the headband 110. Thus, by mechanically adjusting an effective size of the port openings through engagement and disengagement of the headphones 108 with the headband 110, the headphones 108 may be caused to exhibit a first emitted SPL profile 324 over a range of frequencies when engaged with the headband 110, and to exhibit a different, second emitted SPL profile 326 over the range of frequencies when the headphones 108 are disengaged from the headband 110.

As another example, the emitted SPL profile of a speaker may be affected in high frequencies (e.g., treble tones) by selectively attenuating the high frequency sounds emitted by the speaker, and may be varied by adjusting the degree to which the sounds are attenuated as a function of frequency. Thus, in some embodiments, interchangeable ear pads exhibiting different attenuation characteristics may be used with the headphones 108 to adjust the emitted SPL profile of the headphones 108 over high frequencies. For example, referring again to FIG. 1, a first set of ear pads 134A covering at least portions of the headphones 108 may be used when the headphones 108 are used with a first accessory (e.g., the headband 110), and a different second set of ear pads 134B (see FIG. 13) may be used when the headphones 108 are used with a second accessory (e.g., the skull cap 210). The different ear pads 134A and 134B may attenuate the sound emitted from the headphones 108 differently. Thus, one set of ear pads 134A may cause the sound emitted by the headphones 108 to exhibit a first emitted SPL profile 336 over a range of frequencies, and another set of ear pads 134B may cause the sound emitted by the headphones 108 to exhibit a different, second emitted SPL profile 338 over the range of frequencies.

As yet another example, the emitted SPL profile of a speaker may be affected in high frequencies, low frequencies, or both high and low frequencies by selectively altering a size of an acoustical cavity to boost or suppress low frequency sounds, selectively attenuating high frequency sounds, or both. In some embodiments a single ear pad 134' (see FIG. 14) may be reversible, with the headphones 108 exhibiting a first emitted SPL profile 336 over a range of frequencies when the ear pad 134' is attached thereto in a first orientation and the headphones 108 exhibiting a second emitted SPL profile 338 over the range of frequencies when the ear pad 134' is attached thereto in a second, reversed orientation. More specific detail regarding the mechanism for altering the emitted SPL profile by reversing a particular ear pad 134' may alter the emitted SPL profile is provided in connection with FIG. 14.

In additional embodiments, the emitted SPL profiles exhibited by the headphones 108 may be caused to differ from one another through electronic adjustment. For example, the headphones 108 may comprise an electronic signal processor and/or an electronic signal amplifier, and the electronic signal processor and/or the electronic signal amplifier may be operational in two or more different states, which cause the speakers within the headphones 108 to exhibit different emitted SPL profiles. A switch (which may or may not be mechanical in nature) may be used to move the electronic signal processor and/or the electronic signal amplifier from one operational state to another. The switch may be automatically actuated upon engagement and/or disengagement of the headphones with an accessory, such as the headband 110, thereby causing the electronic signal processor and/or the electronic signal amplifier to move from one operational state to another, thereby adjusting the emitted SPL profile of the speakers 108.

Further discussion of non-limiting examples of mechanisms by which the emitted SPL profile of the headphones 108 may be adjusted is provided below with reference to FIGS. 8 through 14.

Figure 8:
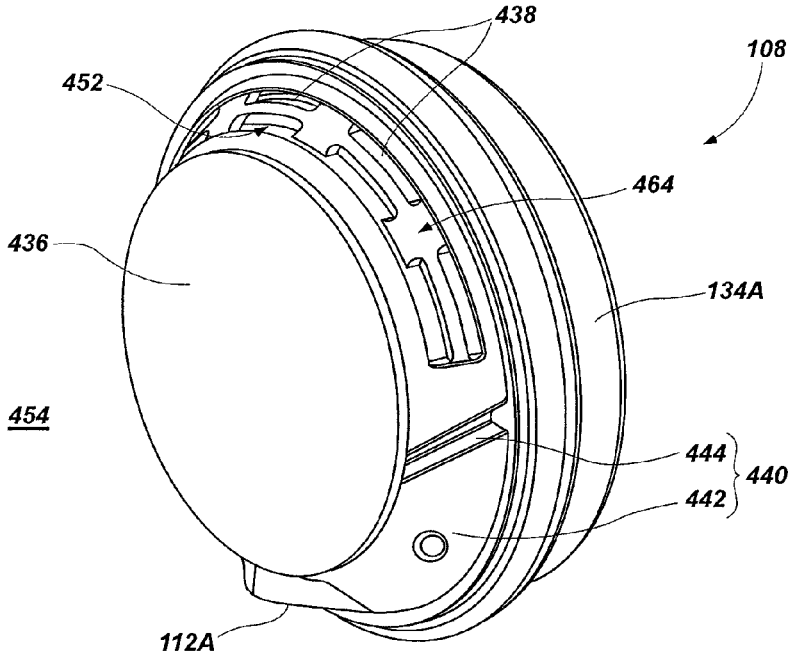
FIG. 8 is a perspective view of a headphone for use with a modular audio headphone device, such as that shown in FIGS. 1 through 3.

FIGS. 8 through 14 are views of portions and components of the modular audio headphone device 100 shown in FIGS. 1, 2, and 3. Referring specifically to FIG. 8, a perspective view of a headphone 108 is shown. The headphone 108 comprises a speaker housing 436 including at least one port opening 438 in the speaker housing 436. The speaker housing 436 may be formed from known materials using known manufacturing techniques for headphones 108 and their components. For example, the speaker housing 436 may comprise thermoplastics formed by injection molding. The headphone 108 may also comprise an ear pad 134A removably attached to the housing 436 and configured to face (e.g., to abut) an ear of a user when the ear pad 134A is attached to the housing 436 and the headphone 108 is attached to a user-wearable accessory. The headphone 108 comprises an attachment structure 440 configured for attachment to another device or structure (e.g., to a headband 110). The attachment structure 440 may comprise, for example, a frustoconical surface 442 of the speaker housing 436 and two or more attachment features 444 on the frustoconical surface 442. The attachment features 444 may comprise, for example, slots extending into the frustoconical surface 442 for receiving at least portions of protrusions on an accessory to which the headphones 108 may be attached. In alternative embodiments, the attachment features 444 may comprise, for example, protrusions extending from the frustoconical surface 442 for at least partial insertion into slots in an accessory to which the headphones 108 may be attached. The surface into which the port openings 438 extend may be recessed relative to the frustoconical surface 442. For example, a recess 464 about 0.5 cm, about 0.25 cm, or about 0.1 cm deep may be formed in the frustoconical surface 442, and the port openings 438 may open into the recess 464.

Figure 9:
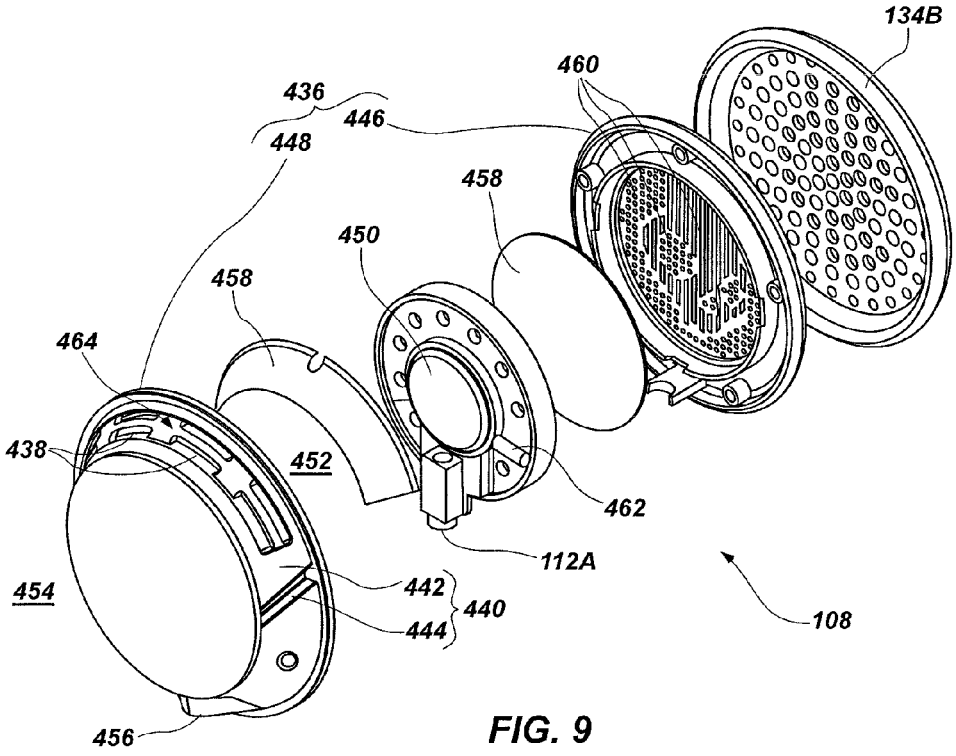
FIG. 9 is an exploded view of the headphone of FIG. 8.

Referring to FIG. 9, an exploded view of a headphone 108 is shown. The speaker housing 436 may comprise a front housing member 446 and a rear housing member 448 configured to receive a speaker 450 at least partially within the speaker housing 436 when the front and rear housing members 446 and 448 are assembled to form the speaker housing 436. The speaker 450 may be any speaker known in the art for use in headphones 108. The front and rear housing members 446 and 448 may be attached to one another by, for example, screws, bolts, rivets, an adhesive, a snap fit, an interference fit, a weld, or other attachments known in the art. When assembled (as shown in FIG. 8), the speaker housing 436 may be coupled to the speaker 450 and may form an acoustic cavity 452 (see also FIG. 10) defined by a space between the speaker housing 436 and the speaker 450 proximate at least a portion of the speaker 450. The port openings 438 may extend between the acoustic cavity 452 and an exterior 454 of the speaker housing 436. The port openings 438 may extend through the rear housing member 448. Optionally, additional openings 460 may extend through the front housing member 446. Each of the port openings 438 and the additional openings 460 may enable sound from the speaker 450 to more easily exit the headphone 108 and be heard by a user. A cross-sectional area of the port openings 438 and, optionally, of the additional openings 460 may affect the emitted SPL profile of the headphone 108, and may be tuned to provide a predetermined and selected detectable SPL profile over a range of frequencies. In other words, the emitted SPL profile may be at least partially a function of the total cross-sectional area of the port openings 438, and, optionally, of the additional openings 460. Thus, the emitted SPL profile may be mechanically adjusted by modifying a cross-sectional area of at least the port openings 438. As previously mentioned, the cross-sectional area of at least the port openings 438 may be automatically adjusted by engagement of the headphones 108 with the headband 110, such that surfaces of the headband 110 cover at least a portion of the port openings 438.

In addition or as an alternative to adjusting the emitted SPL profile of the headphones 108 through mechanical adjustment (e.g., adjustment of an effective size of a port for an acoustical cavity or through adjustment of attenuation of the emitted sound frequencies), the emitted SPL profile of the headphones 108 may be adjusted through attenuation of sound emitted by the speakers within the headphones 108.

In some embodiments, the headphone 108 may be used with either a first ear pad 134A (FIG. 8) or a second ear pad 134B (FIG. 9). The first and second ear pads 134A and 134B may differ from one another in at least one aspect, such as, for example, material composition, porosity, thickness, and presence, size, and configuration of apertures extending through the ear pads 134A and 134B adjacent the front housing member 446. Each of the first and second ear pads 134A and 134B may be individually attached to the front housing member 446, for example, by placing a respective ear pad 134A or 134B over and around the front housing member 446 or at least a portion thereof. The ear pads 134A and 134B may also extend around at least a portion of the rear housing member 448 in some embodiments. As another example, the first and second ear pads 134A and 134B may be connected to the front housing member 446 by magnetic attraction, where one of the housing 436 and the ear pads 134A and 134B may comprise a magnet 435 (e.g., mounted within the housing 436 (see FIG. 10)) and the other of the housing 436 and the ear pads 134A and 134B may comprise a ferromagnetic material 437 (e.g., embedded in the material of the ear pads 134A and 134B (see FIG. 10)) to be attracted by the magnet. The first and second ear pads 134A and 134B may attenuate an emitted SPL profile of the headphone 108 to provide a predetermined and selected detectable SPL profile over a range of frequencies. Thus, the emitted SPL profile may be mechanically adjusted by selectively placing one of the first and second ear pads 134A and 134B on the speaker housing 436 or by removing the first and second ear pads 134A and 134B from the speaker housing 436. In other embodiments, additional ear pads (e.g., third, fourth, fifth, etc.) may further mechanically adjust an emitted SPL profile of the headphone 108 to more than two tunable states through different ear pad material compositions, porosities, thicknesses, and presences, sizes, and configurations of openings.

Figure 14:
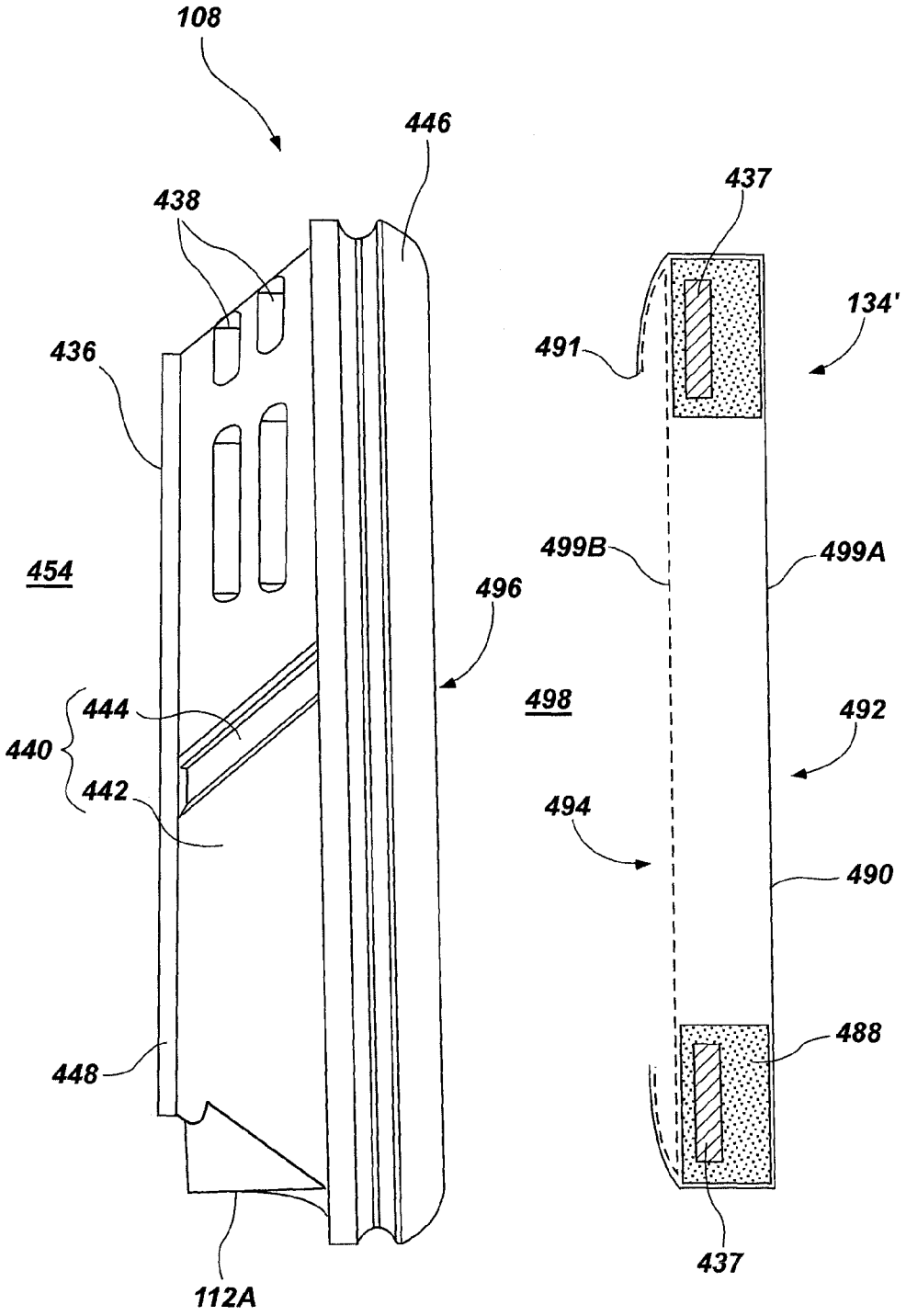
FIG. 14 is a partial cross-sectional exploded view of a headphone including another embodiment of an ear pad.

In other embodiments, the headphone 108 may be used with one or more reversible ear pads 134' (see FIG. 14). For example, a reversible ear pad 134' may comprise differences in properties and characteristics from one side to the other, such as, for example, in acoustic attenuation, ability to seal against a surface (e.g., of a user's ear), and effective acoustic cavity size. The reversible ear pad 134' may be attached to the front housing member 446, for example, by placing the ear pad 134' over and around the front housing member 446 or at least a portion thereof in one of two opposing orientations. The reversible ear pad 134' may also extend around at least a portion of the rear housing member 448 in some embodiments. As another example, the reversible ear pads 140' may be connected to the front housing member 446 by magnetic attraction, where one of the housing 436 and the reversible ear pad 134' may comprise a magnet (e.g., mounted within the housing 436) and the other of the housing 436 and the reversible ear pad 134' may comprise a ferromagnetic material (e.g., embedded in the material of the ear pads 134') to be attracted by the magnet. The reversible ear pad 134' may attenuate an emitted SPL profile of the headphone 108 to provide a predetermined and selected detectable SPL profile over a range of frequencies. Thus, the emitted SPL profile may be mechanically adjusted by selectively placing the reversible ear pad 134' on the speaker housing 436 in one of two opposing orientations. In other embodiments, additional reversible ear pads (e.g., second, third, fourth, fifth, etc.) may further mechanically adjust an emitted SPL profile of the headphone 108 to more than two tunable states through different ear pad material compositions, porosities, thicknesses, and presences, sizes, and configurations of openings.

In some embodiments, an emitted SPL profile may be mechanically modified both by adjusting a cross-sectional area of the port openings 438 and by placing one of the first and second ear pads 134A and 134B, or placing the reversible ear pad 134', in one of two derrent (e.g., opposing) orientations on the speaker housing 436. A different range of frequencies may be modified by adjusting the cross-sectional area of the port openings 438 from the range of frequencies modified by placing one of the first and second ear pads 134A and 134B on the speaker housing 436. For example, adjusting the cross-sectional area of the port openings 438 may primarily modify the emitted SPL profile in low- to mid-range frequencies (e.g., frequencies between about 30 Hz and about 1,000 Hz), while placing one of the first and second ear pads 134A and 134B on the speaker housing 436, or removing the first and second ear pads 134A and 134B from the speaker housing 436, may primarily modify the emitted SPL profile in mid- to high-range frequencies (e.g., frequencies between about 5,000 Hz and about 15,000 Hz). Placing the reversible ear pad 134' in one of two opposing orientations on the speaker housing 436 may primarily modify the emitted SPL profile in low- to mid-range frequencies, mid- to high-range frequencies, or both, depending on the configuration of the reversible ear pad 134'. In other embodiments, an emitted SPL profile may be mechanically modified within a range of frequencies only by one of adjusting a cross-sectional area of the port openings 438 and placing one of the first and second ear pads 134A and 134B or placing the reversible ear pad 134' in one of two opposing orientations on the speaker housing 436.

In some embodiments, an emitted SPL profile may be electrically modified over a range of frequencies. For example, referring to FIG. 9, the headphone 108 may optionally include a switch 462 configured to be engaged when the headphone 108 is attached to a first user-wearable accessory 110 (e.g., a headband 110, as in FIG. 1) and disengaged when the headphone 108 is detached from the first user-wearable accessory 110. As a non-limiting example, the headphone 108 may include a switch 462 comprising a button protruding from the frustoconical surface 442 that is depressed when the headphone 108 is attached to the first user-wearable accessory 110, and is released when the headphone 108 is detached from the first user-wearable accessory 110. In other embodiments, a switch 462 may be activated and deactivated by magnets in one or both of the user-wearable accessory 110 and the headphone 108, by light sensors in the headphone 108 that are obscured by portions of the user-wearable accessory 110, by proximity sensors in one or both of the user-wearable accessory 110 and the headphone 108, or by other switch configurations known in the art. Electric modification of the emitted SPL profile may comprise, for example, adjustment of an electronic signal processor, turning on or off an amplifier, changing a gain of an amplifier, changing default settings of a volume controller, or otherwise changing an electronic signal (e.g., an audio signal) or an electric power source associated with the headphone 108. In some embodiments, the emitted SPL profile may be both mechanically and electrically modified upon engagement and/or disengagement of the headphones 108 with an accessory, such as the headband 110. In other embodiments, the emitted SPL profile may be only mechanically modified or only electrically modified.

With continued reference to FIG. 9, an access port 456 in the speaker housing 436 may extend between the acoustic cavity 452 and the exterior 454 of the speaker housing 436, which may enable an audio jack 112 (e.g., an audio jack 112B of the wiring system 104 (FIGS. 1, 2, and 3)) to detachably connect to an audio jack 112A connected to the speaker 450. Thus, the audio jack 112A and the speaker 450 of the headphone 108 may be located within the speaker housing 436, and may be accessed through the speaker housing 436. Optional layers of acoustic felt 458 may be interposed between the front and rear housing members 446 and 448 and the speaker 450.

Figure 10:
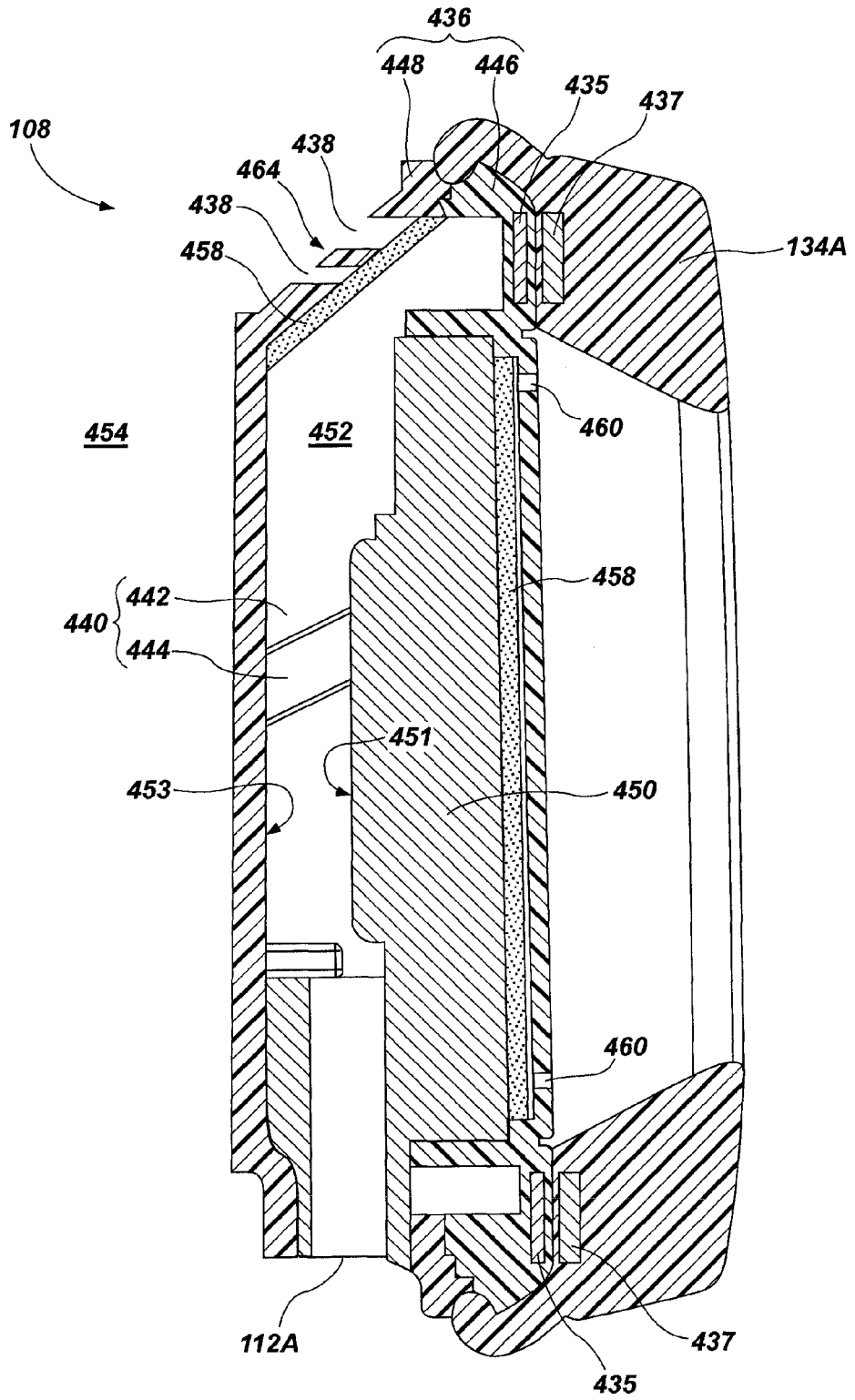
FIG. 10 is a cross-sectional view of the headphone of FIG. 8.

Referring to FIG. 10, a simplified cross-sectional view of a headphone 108 is shown in an assembled state. When assembled, the acoustic cavity 452 may be located between and defined by a rearmost surface 451 of the speaker 450 and a frontmost surface 453 of the rear housing member 448. A sound path may extend from the acoustic cavity 452, through the port openings 438, out of the recess 464 toward an ear of the user. For example, the recess 464 may define a space between the frustoconical surface 442 of the speaker housing 436 and a mating frustoconical surface 478 (see FIG. 11) of the headband 110 (see FIG. 11) to define a sound path from the acoustic cavity 452, through the port openings 438, along the recess 464 between the frustoconical surfaces 442 and 478 (see FIG. 11) of the speaker housing 436 and the headband 110 (see FIG. 11), and out at least one notch 482 (see FIGS. 11 and 12) aligned with the recess 464 and at least a portion of the port openings 438. In some embodiments, as shown in FIG. 10, an ear pad 134A may be attached to the front housing member 446, for example, by placing the ear pad 134A over and around a portion of the front housing member 446 and by magnetically attracting a ferromagnetic material 437 embedded in the ear pad 134A to a magnet 435 embedded in the front housing member 446.

Figure 11:
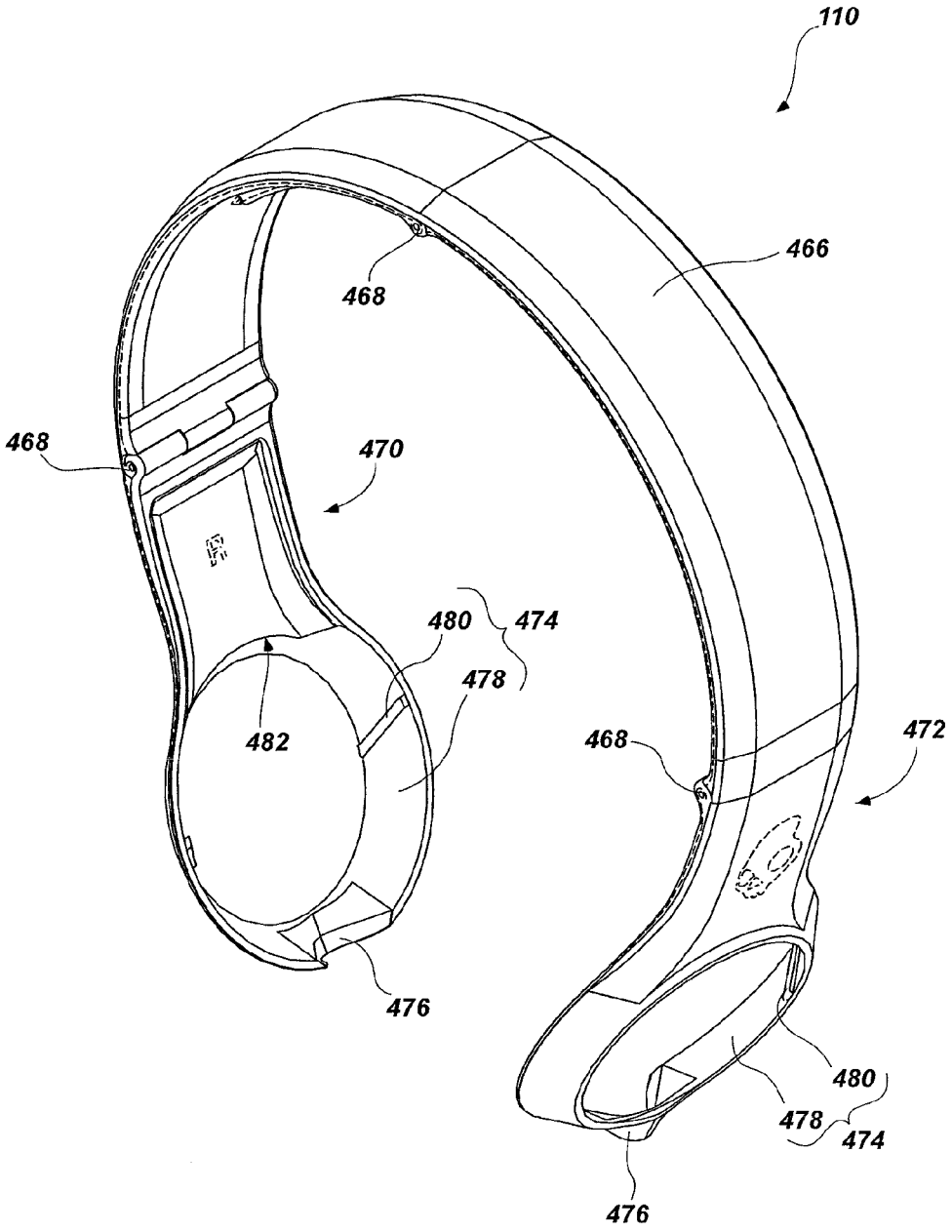
FIG. 11 is a perspective view of the headband used with the modular audio headphone device of FIG. 1.

Referring to FIG. 11, a perspective view of the headband 110 of the modular audio headphone device 100 of FIG. 1 is shown. The headband 110 comprises a band 466 configured for placement over a head of a user. When in use, the band 466 may support the headphones 108 (FIG. 1) by resting on the head of the user. The band 466 may be collapsible for storage or ease in transport. For example, the band 466 may include at least one hinge 468. As a specific, non-limiting example, the band 466 may include a hinge 468 at an apex of the band 466, a hinge 468 in a right arm 470 of the band 466, and a hinge in a left arm 472 of the band 466. Thus, the right and left arms 470 and 472 of the band 466 may swivel upwardly and the apex of the band 466 may be folded in half to place the headband 110 in a compact state for storage or transport.

The headband 110 includes two attachment portions 474 at opposing ends of the band 466 configured for attachment to the attachment structures 440 of the headphones 108 (FIG. 2). The attachment portions 474 may extend from the respective ends of the right and left arms 470 and 472 of the band 466. The attachment portions 474 may be located to position headphones 108 (FIG. 1) attached to the attachment portions 474 on or over the ears of a user. The right and left arms 466 and 468 may be extensible, enabling a user to adjust the positioning of the attachment portions 474, and the headphones 108 (FIG. 1) removably attached to the attachment portions 474, to accommodate different head sizes and ear positions. The attachment portions 474 may include access indentations 476 configured to accommodate the access ports 456 of the headphones 108 (FIG. 9).

Each attachment portion 474 may comprise, for example, a mating frustoconical surface 478 configured to abut against and conform to the frustoconical surface 442 of the attachment structure 440 of a headphone 108 and two or more attachment features 480 configured to engage with the attachment features 444 on the frustoconical surface 442 of the attachment structure 440 of the headphone 108. The attachment features 480 may comprise, for example, protrusions extending from the mating frustoconical surface 478 for at least partial insertion into slots of the attachment features 444. In other embodiments, the attachment features 480 may comprise, for example, slots extending into the mating frustoconical surface 478 for receiving at least portions of protrusions of the attachment features 444. The headband 110 may comprise, for example, at least one notch 482 in the frustoconical surface 478 configured to align with at least a portion of a port opening 438 of a headphone 108 (FIG. 8) so as to provide a selected effective size of the port. In other embodiments, the headband 110 may comprise a hole, gap, space, or other void in the frustoconical surface 478 configured to align with the port opening 438 of the headphone 108. The headband 110 may be formed from known materials using known techniques for formation of headphone assemblies. For example, the headband 110 may comprise a thermoplastic and may be formed by injection molding.

With combined reference to FIGS. 8 and 11, the attachment portions 474 of the headband 110, the attachment structures 440 of the headphones 108, or both may elastically deform and snap back into shape when the attachment structures 440 of the headphones 108 are removably attached to the attachment portions 474 of the headband 110. More specifically, the second attachment features 480 may snap into the first attachment features 444 and mechanical interference between the second attachment features 480 and the surfaces defining the first attachment features 444 may retain the headphones 108 attached to the headband 110. Thus, the speaker assemblies 102 may be removably attached to the headband 110 using a snap fit. To detach the speaker assemblies 102 from the headband 110, the speaker assemblies 102 may be rotated relative to the headband 110, which may cause the attachment portions 474 of the headband 110, the attachment structures 440 of the speaker assemblies, or both to elastically deform and release the speaker assemblies 102 from the headband 110. Thus, the second attachment features 480 may be extracted from the first attachment features 444, and the speaker assemblies 102 may be detached from the headband 110.

Figure 12:
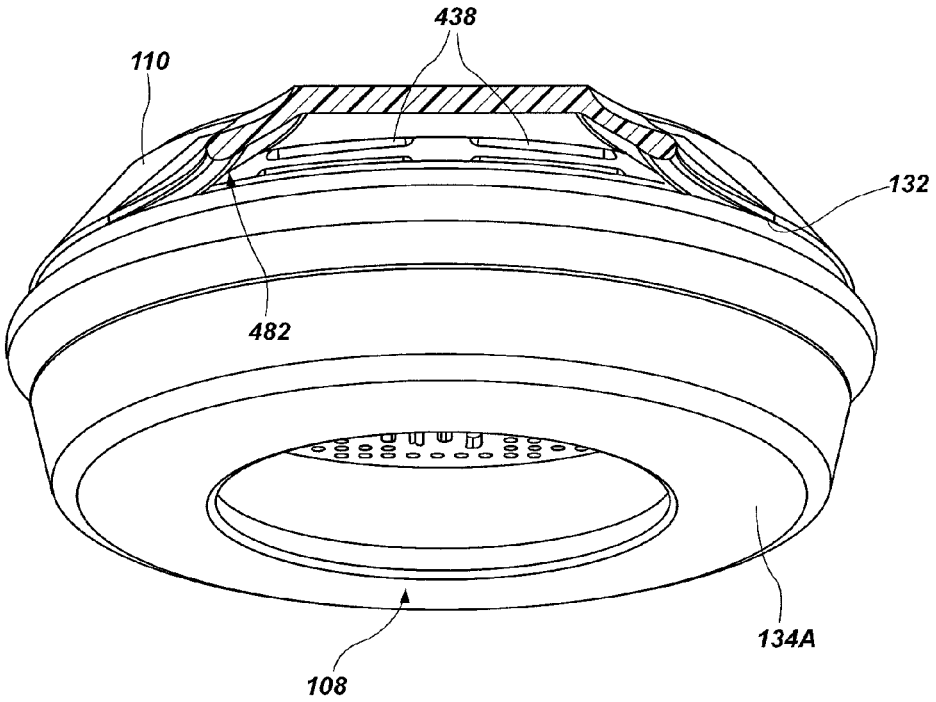
FIG. 12 is a cross-sectional side view of the modular audio headphone device and user-wearable accessory of FIG. 1.

Referring to FIG. 12, a cross-sectional side view of a headphone 108 is shown. More specifically, FIG. 12 illustrates portions of the port openings 438 of the headphone 108, which may remain exposed when the headphone 108 is attached to the headband 110. The mating frustoconical surface 478 may be configured to cover at least a portion of the port openings 438, and the notch 482 may modify a cross-sectional area of the port openings 438 when the headphone 108 is attached to the headband 110. For example, the port openings 438 may have a first effective cross-sectional area when the headphone 108 is detached from the headband 110 (FIGS. 8 and 9). The port openings 438 may have a second, different effective cross-sectional area when the headphone 108 is attached to the headphone 110. For example, a portion of the port openings 438 may be covered by the frustoconical surface 478 of the headband 110 and another portion of the port openings 438 may be exposed by the notch 482 in the frustoconical surface of the headband 110 at the interface between the headband 110 and the headphone 108. In other words, the second cross-sectional area of the port openings 438 when the headphone 108 is attached to the headband 110 may be smaller than the first cross-sectional area of the port openings 438 when the headphone 434 is detached from the headband 110. In addition, the recess 464 into which the port openings 438 may open may enable sound waves travelling through the port openings 438 to more easily flow from even those portions of the port openings 438 that are covered, through the notch 482, for detection by a user. Such modification of the cross-sectional area of the port openings 438 may adjust the emitted SPL profile of the headphone 108 over a range of frequencies.

Figure 13:
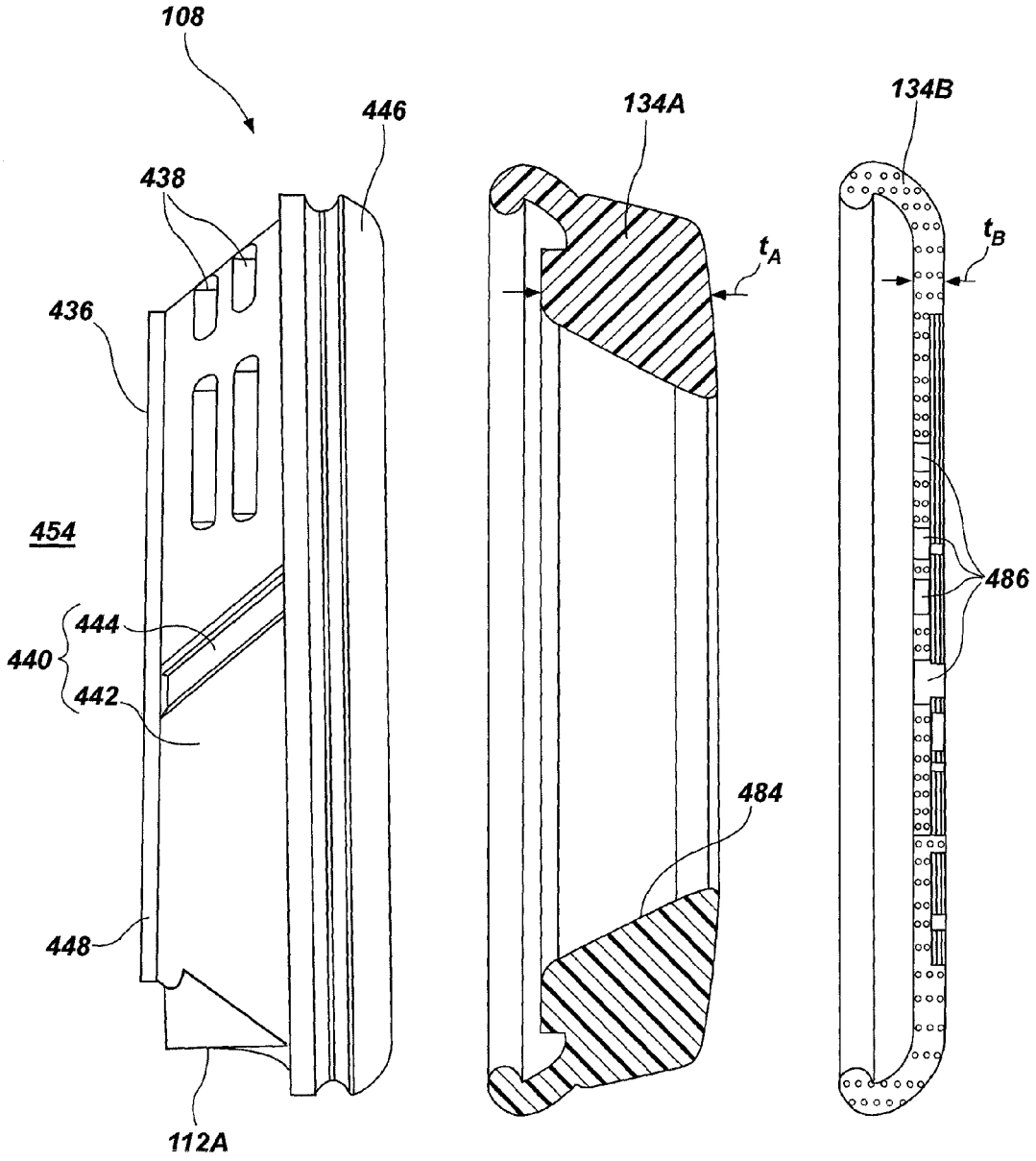
FIG. 13 is a partial cross-sectional exploded view of a headphone including interchangeable first and second ear pads.

Referring to FIG. 13, a partial cross-sectional exploded view of a headphone 108 including first and second ear pads 134A and 134B is shown. The first ear pad 134A may comprise at least one of a different material composition, a different density, and a different porosity from a material composition, a density, or a porosity of the second ear pad 134B. For example, the first ear pad 134A may comprise an elastomeric ear pad (e.g., a silicone rubber ear pad or an ethylene-vinyl acetate ear pad) and the second ear pad 134B may comprise a foam cushion ear pad (e.g., a polyethylene foam ear pad or a polyurethane foam ear pad). The first ear pad 134A may comprise a thickness $t_A$ different from a thickness $t_B$ of the second ear pad 134B. For example, the first ear pad 134A may comprise a thickness $t_A$, as measured from a surface of the ear pad 134A configured to abut a frontmost surface of the front housing member 446 to a frontmost surface of the ear pad 134A, at least 1.0, 2.0, or 4.0 times greater than a thickness $t_B$ of the second ear pad 134B, as measured using the same reference surfaces. The first ear pad 134A may comprise at least one opening 484 having a different configuration from at least one opening 486 of the second ear pad 134B. For example, the first ear pad 134A may comprise a single opening 484 extending through the thickness $t_A$ of the first ear pad 134A and comprising at least 50% of a surface area of a frontmost surface of the first ear pad 134A and the second ear pad 134B may comprise a plurality of openings 486 extending through the thickness $t_B$ of the second ear pad 134B and comprising less than 50% of a surface area of a frontmost surface of the second ear pad 134B. Such differences in the first and second ear pads 134A and 134B may attenuate an emitted SPL profile over a range of frequencies of the headphone 108 to differing degrees when the first and second ear pads 134A and 134B are attached respectively to the headphone 108.

Referring to FIG. 14, a partial cross-sectional exploded view of a headphone 108 including another embodiment of an ear pad 134' is shown. The ear pad 134' may comprise an interior pad 488 and an exterior skin 490 (e.g., a fabric). The interior pad 488 may comprise any of the materials, densities, porosities, thicknesses, or openings described previously in connection with the first and second ear pads 134A and 134B (see FIG. 13). The interior pad 488 may be positioned within (e.g., sewn inside, sealed inside, etc.) the exterior skin 490. The exterior skin 490 may comprise a constricted portion 491 (e.g., a skirt with an elastic waist) to enable the reversible ear pad 134' to engage with the headphone 108 and be retained thereon in some embodiments. In other embodiments, one of the headphone 108 and the reversible ear pad 134' may comprise a magnet 435 (e.g., mounted within the housing 436 (see FIG. 10)) and the other of the headphone 108 and the reversible ear pad 134' may comprise a ferromagnetic material 437 (e.g., embedded in the interior pad 488 of the ear pads 134') to be attracted by the magnet.

The exterior skin 490 may comprise two opposing sides, a first side 492 and a second, opposing side 494, which may exhibit different SPL-profile-altering characteristics. For example, the first side 492 of the skin 490 may comprise a first material, such as, for example, leather or synthetic leather (e.g., polyurethane or PVC), and the second side 494 of the skin 490 may comprise a second, less acoustically attenuating (e.g., more porous) material, such as, for example, a foam or an open-weave fabric. In such an example, the first side 492 of the skin 490 may form a seal over a front face 496 of the headphone 108, reducing a size of an additional acoustic cavity 498 defined between the speaker 450 (see FIG. 9) and the skin 490, when the first side 492 faces the headphone 108. Such a configuration may serve to boost low- to mid-frequency output. When the second side 494 faces the headphone 108, the effective size of the additional acoustic cavity 498 may be increased and sound may have additional pathways to escape the additional acoustic cavity 498. Such a configuration may suppress low- to mid-frequency output. In addition, high-frequency sound energy may be absorbed to a lesser extent by the first material (e.g., may be better reflected by the first material) when the first side 492 faces the headphone 108, while high-frequency sound energy may be absorbed to a greater extent (e.g., may reflected to a lesser extend) by the ear pad foam when the second side 494 faces the headphone 108. As a specific, non-limiting example, the level of low-, mid-, and high-frequency output can be tuned by creating multiple holes in a sound-reflective material for the skin 490, such as, for example, leather or synthetic leather, which may be placed on both sides 492 and 494 of the skin 490. Different balances between low-, mid-, and high-frequency output can be achieved, for example, by using different hole locations, different hole sizes, different ear pad foams, and by varying the manner in which these features are combined.

As another example, the first side 492 of the skin 490 may comprise a first material presenting a relatively uniform, flat contact surface 499A, such as, for example, leather or synthetic leather (e.g., polyurethane or PVC), and the second side 424 of the skin 490 may comprise a second material presenting a relatively non-uniform, rough contact surface 499B, such as, for example, a velvet. In such an example, the contact surface 499A of the first side 492 of the skin 490 may seal the acoustic cavity 498, while the contact surface 499B of the second side 494 may comprise additional pathways for sound to escape from the acoustic cavity 498 to the exterior 454. Such a configuration may suppress low- to mid-frequency output. Providing multiple reversible ear pads 134' may enable a user to selectively alter the emitted SPL profile of a headphone 108 based on personal preference, music selection, associated accessory (e.g., headband 110 or knitted skull cap 210), and surrounding environment using a variety of interior pads 488 (e.g., with different materials, densities, porosities, thicknesses, or openings) and materials (e.g., leather, synthetic leather, porous synthetic leather, foam, loose-weave fabric, velvet, etc.) for the first and second sides 492 and 424 of the skin 490.

In addition to altering the emitted SPL profile of the headphone 108, the reversible ear pad 134' may enable a user to selectively change other characteristics of the headphone 108. For example, the first and second sides 492 and 494 of the skin 490 may be different colors or may comprise different symbols or lettering thereon, which may be purely aesthetic or may indicate to the user how a given side 492 or 494 will affect the emitted SPL profile. As another example, the first and second sides 492 and 494 may be configured for use in different environments and while engaging in different activities, such as, for example, a relatively non-porous, non-cushioned material on the first side 492 for indoor, casual use and a relatively breathable, cushioning, acoustically transmissive (e.g., to grant ambient noise a path to the user's ear) material on the second side 494 for outdoor, active use.

Figure 15:
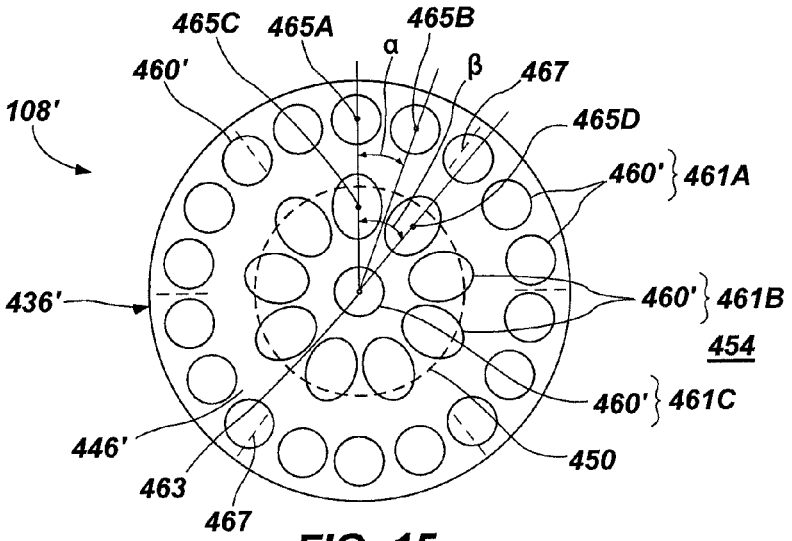
FIG. 15 is a front view of another embodiments of a headphone.

Referring to FIG. 15, a front view of another embodiment of a headphone 108' is shown. The front housing member 446' of the speaker housing 436' may comprise openings 460' to define a grille through which sound may pass from the speaker 450 to the exterior 454 of the speaker housing 436'. The openings 460' may be positioned in a pattern on the front housing member 446'. As a specific, non-limiting example, the openings 460' may form concentric circles in the front housing member 446', with an outer ring 461A of openings 460' proximate a periphery of the front housing member 446', a central portion 461C having a single opening 460', and an inner ring 461B of openings 460' located between the outer ring 461A and the central portion 461C. The openings 460' in individual rings 461A and 461B may be spaced at differing intervals in some embodiments. For example, an angle $\alpha$ defined by lines extending from a central axis 463 of the front housing member 446' to intersect central axes 465A and 465B of adjacent openings 460' in the outer ring 461A may be between about 10° and about 30° (e.g., about 20°). Another angle β defined by lines extending from the central axis 463 of the front housing member 446' to intersect central axes 465C and 465D of adjacent openings 460' in the inner ring 461B may be between about 30° and about 50° (e.g., about 40°). In other embodiments, the openings 460' in the outer and inner rings 461A and 461B may be spaced at the same intervals. In yet other embodiments, the openings 460' may be located in other patterns (e.g., polygons of expanding sizes, lined grids, forming a picture or symbol, such as a logo, forming a message, such as a slogan, etc.) on the front housing member 446'.

In some embodiments, the speaker housing 436' may comprise ear pad alignment members 467 (e.g., ridges or grooves), which may engage with mating alignment members 469 (see FIG. 16) of an ear pad 134" (see FIG. 16) to orient the ear pad 134" (see FIG. 16) with respect to the speaker housing 436'. The ear pad alignment members 467 may be positioned at set intervals around the circumference of the speaker housing 436', such as, for example, every 90°, 60°, 45°, or 30°.

Figure 16:
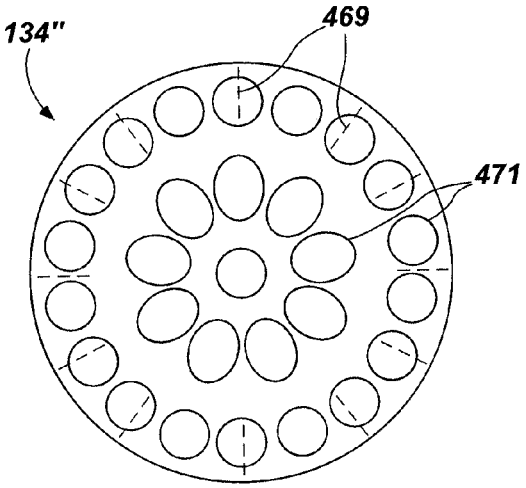
FIG. 16 is a front view of another embodiment of an ear pad.

Referring to FIG. 16, a front view of another embodiment of an ear pad 134" is shown. The ear pad 134" may comprise aligning openings 471, at least some of which may selectively align with and become misaligned from the openings 460' (see FIG. 15) of the speaker housing 436' (see FIG. 15), depending on the relative orientations of the speaker housing 436' (see FIG. 15) and the ear pad 134", to alter an emitted SPL profile of the headphone 108' (see FIG. 15). In some embodiments, the aligning openings 471 may be positioned in the same pattern as the openings 460' (see FIG. 15) of the speaker housing 436' (see FIG. 15), which may comprise the pattern forming concentric circles described previously or any other pattern. For example, where the pattern of the aligning openings 471 is identical to the pattern of the openings 460' (see FIG. 15) in the speaker housing 436' (see FIG. 15), the ear pad 134" and the speaker housing 436' may be oriented with the patterns directly overlying each other such that a direct path from the speaker 450, through the openings 460' (see FIG. 15) in the speaker housing 436' (see FIG. 15) and the aligning openings 471 in the ear pad 134', to the exterior 454 (see FIG. 15) of the headphone 108' (see FIG. 15). In other embodiments, the aligning openings 471 may be positioned in a pattern different from the pattern defined by the openings 460' (see FIG. 15) of the speaker housing 436' (see FIG. 15), although at least some of the aligning openings 471 may nonetheless be positioned to selectively align with and misalign from corresponding openings 460' (see FIG. 15) of the speaker housing 436' (see FIG. 15).

In some embodiments, the ear pad 134" may comprise mating alignment members 469 (e.g., grooves or ridges), which may engage with ear pad alignment members 467 (see FIG. 15) of a speaker housing 436' (see FIG. 15) to orient the ear pad 134" with respect to the speaker housing 436' (see FIG. 15). The mating alignment members 469 may be positioned at set intervals around the circumference of the ear pad 134", such as, for example, every 45°, 30°, 22.5°, or 15°. In some embodiments, the mating alignment members 469 may be positioned around the circumference of the ear pad 134" with a greater frequency (e.g., twice as frequent, three times as frequent, etc.) than the frequency with which the ear pad alignment members 467 (see FIG. 15) are positioned around the circumference of the speaker housing 436' (see FIG. 15) to ensure that the ear pad 134" is capable of being oriented in at least two different orientations with respect to the speaker housing 436' (see FIG. 15) to selectively align the aligning openings 471 of the ear pad 134" with the openings 460' (see FIG. 15) of the speaker housing 436' (see FIG. 15) and misalign the aligning openings 471 of the ear pad 134" from the openings 460' (see FIG. 15) of the speaker housing 436' (see FIG. 15). As a specific, non-limiting example, a first orientation of the ear pad 134' in which all of the aligning openings 471 align with corresponding openings 460' (see FIG. 15) of the speaker housing 436' (see FIG. 15) is shown in FIG. 16.

Figure 17:
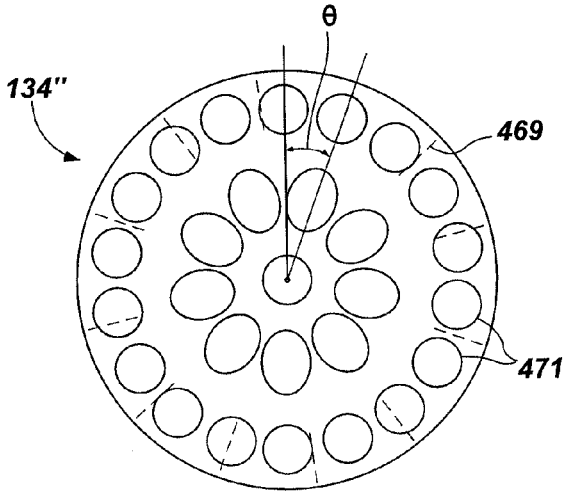
FIG. 17 is a rotated front view of the ear pad of FIG. 16.

Referring to FIG. 17, a rotated front view of the ear pad 134" of FIG. 16 is shown. The ear pad 134" may be rotated with respect to the speaker housing 436" (see FIG. 15) into a second orientation in which at least some of the aligning openings 471 misalign from corresponding openings 460' (see FIG. 15) of the speaker housing 436' (see FIG. 15). For example, the ear pad 134" may be rotated an angle θ of between about 10° and about 80° (e.g., about 20°, 30°, 45°, or 60°) into the second orientation.

Figure 18:
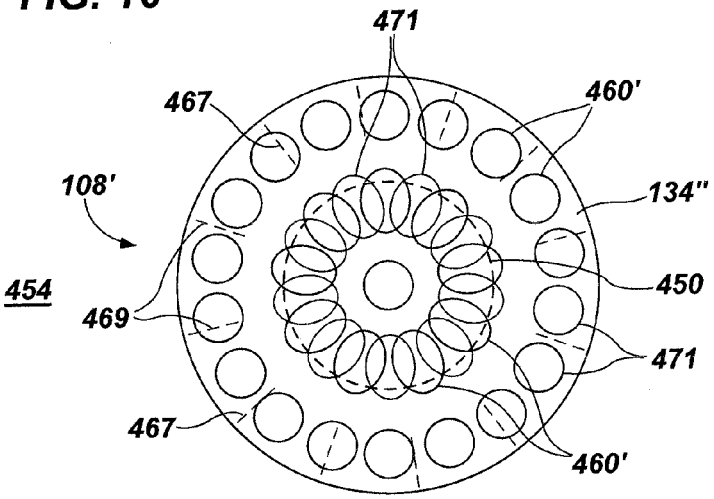
FIG. 18 is a front view of the rotated ear pad of FIG. 17 placed on the headphone of FIG. 15.

Referring to FIG. 18, a front view of the rotated ear pad 134" of FIG. 17 placed on the headphone 108' of FIG. 15 is shown. In some embodiments, reorienting the ear pad 134" with respect to the speaker housing 436' (see FIG. 15) may misalign some of the aligning openings 471 from all potentially corresponding openings 460' of the speaker housing 436' (see FIG. 15) while others of the aligning openings 471 may simply be realigned with different openings 460' of the speaker housing 436' (see FIG. 15). As a specific, non-limiting example, where the openings 460' and aligning openings 471 are positioned in the pattern described previously in connection with FIG. 15 and where the ear pad 134" has been rotated about 20° with respect to the speaker housing 436' (see FIG. 15), the aligning openings 471 in the outer ring 461A (see FIG. 15) may be realigned with openings 460' different from the openings 460' with which they were previously aligned, the aligning openings 471 in the inner ring 461B (see FIG. 15) may be at least partially misaligned with (e.g., may partially obstruct) the corresponding openings 460', and the aligning opening 471 at the central position 461C (see FIG. 15) may remain aligned with the corresponding opening 460'. In other embodiments, various other combinations of realigning, misaligning, and remaining aligned may result from reorienting the ear pad 134" with respect to the speaker housing 436' (see FIG. 15).

By orienting the ear pad 134' with respect to the speaker housing 436' (see FIG. 15) to selectively align the aligning openings 471 of the ear pad 134" with openings 460' of the speaker housing 436' (see FIG. 15) and misalign the aligning openings 471 of the ear pad 134" from openings 460' of the speaker housing 436' (see FIG. 15), the emitted SPL profile of the headphone 108 may be altered. For example, selectively obstructing and unobstructing at least some of the openings 460' alter the high frequency response of the headphone 108'. More specifically, partially obstructing the openings 460' in the speaker housing 436' with portions of the ear pad 134" may suppress high- to mid-range frequency output of the headphone 108', while leaving the openings 460' unobstructed may leave the high- to mid-range frequency output of the headphone 108' unaltered.

Figure 19:
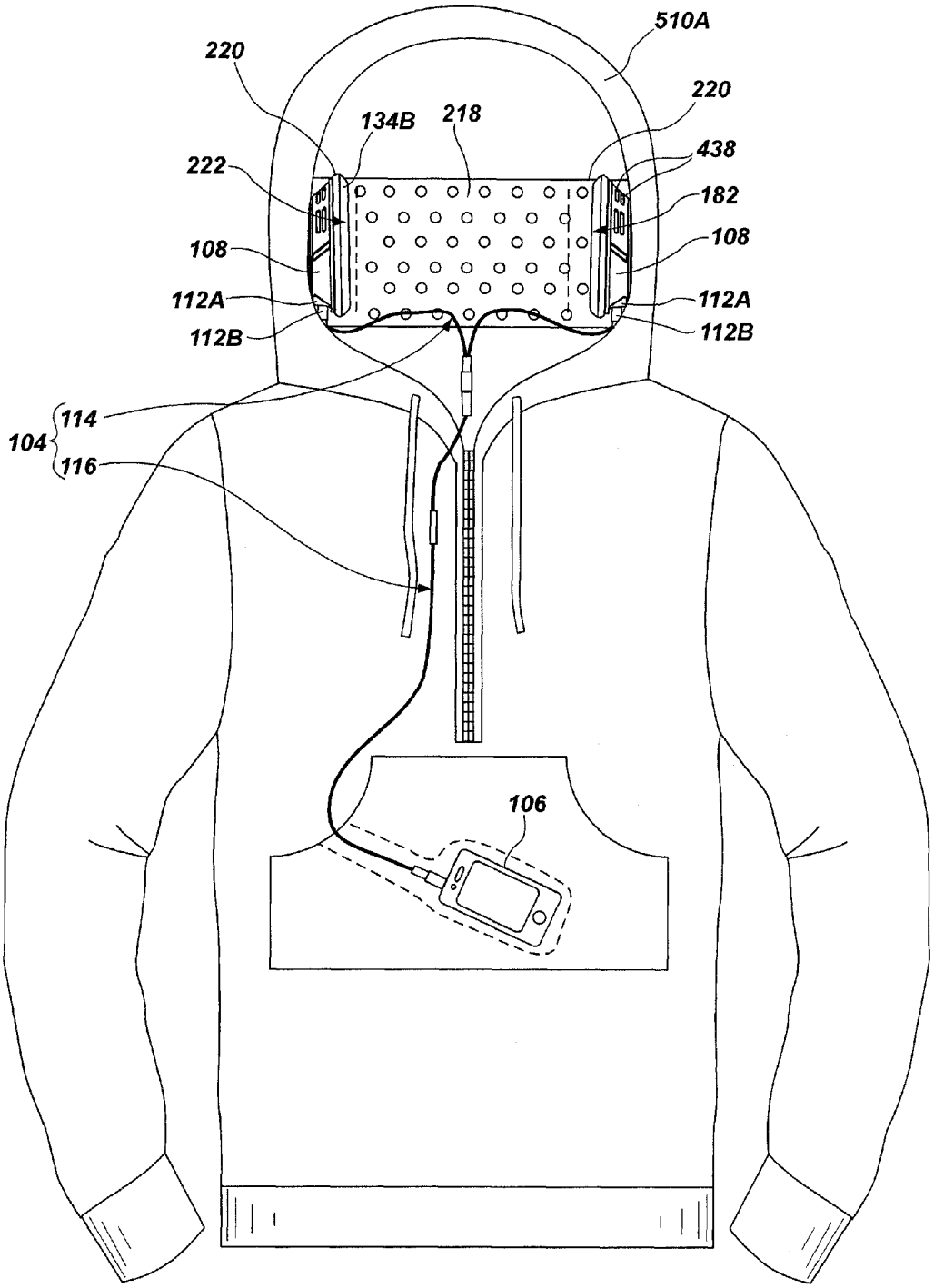
FIG. 19 is a front view of a modular audio headphone device for use with a user-wearable accessory comprising a hood.
Figure 20:
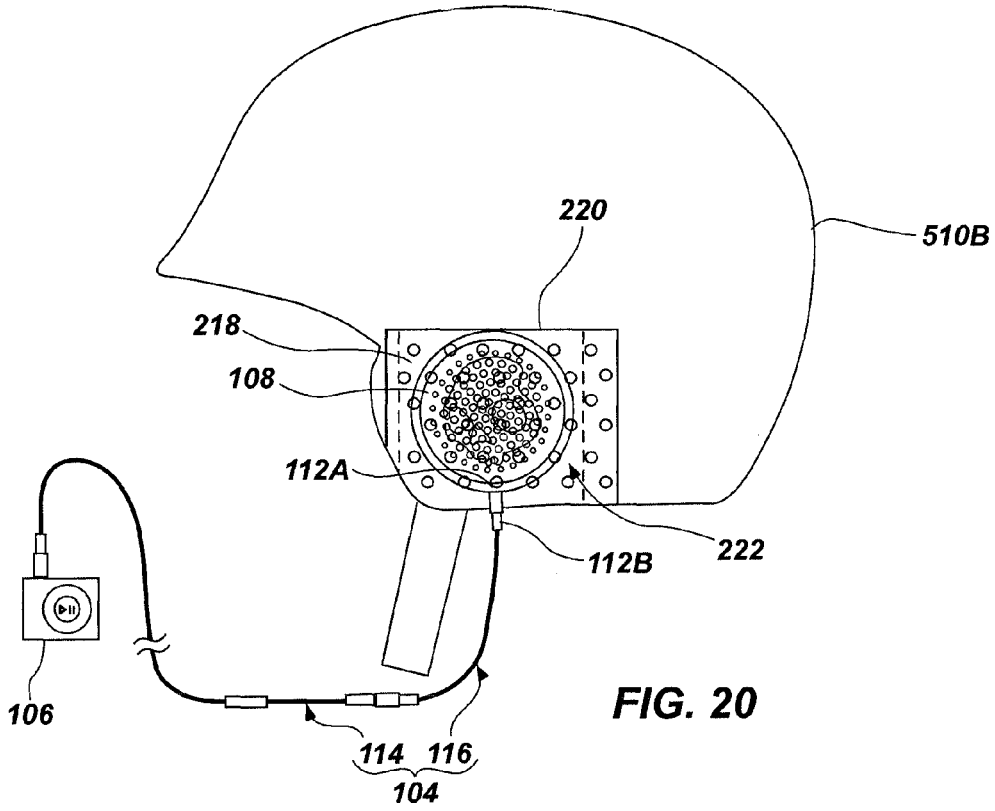
FIG. 20 is an interior side view of a modular audio headphone device for use with a user-wearable accessory comprising a helmet.
Figure 21:
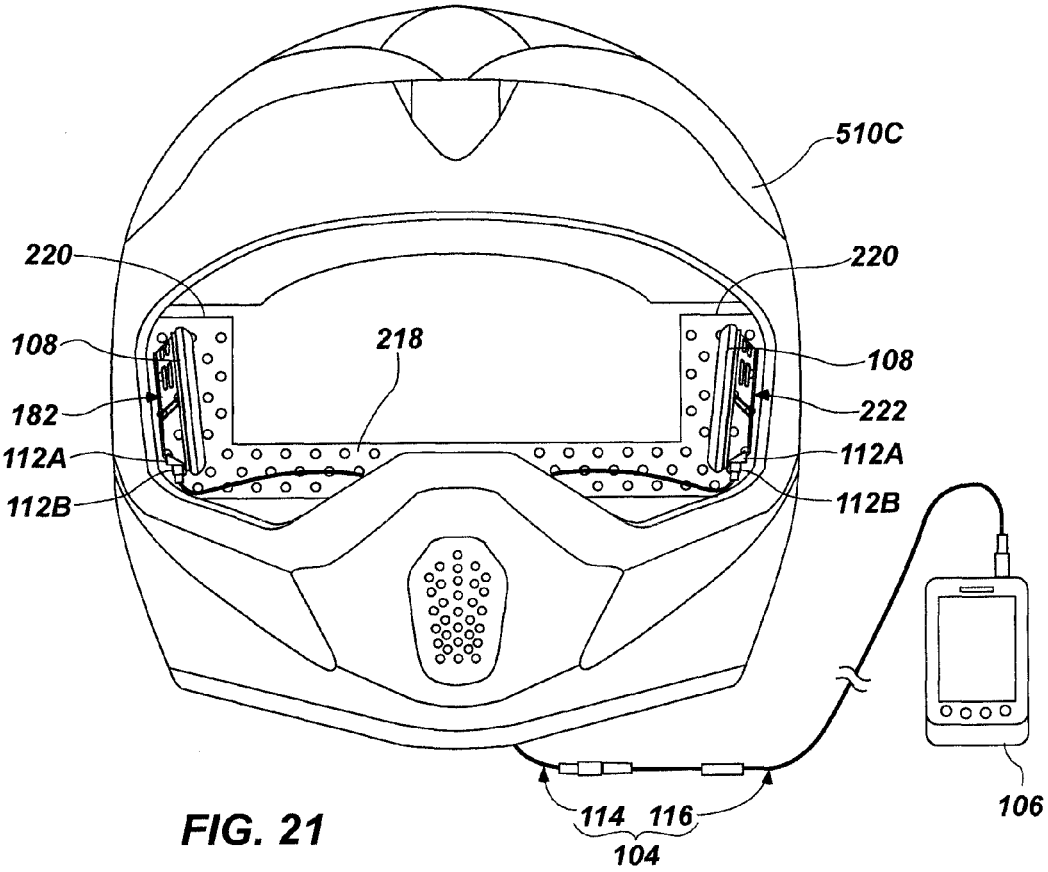
FIG. 21 is a front view of a modular audio headphone device for use with a user-wearable accessory comprising a full face helmet.

FIGS. 19 through 21 illustrate additional accessories that may be employed with the modular audio headphone device 100. FIG. 19 illustrates a hood 510A (e.g., a hooded jacket, a hooded sweatshirt, or a "hoodie") in which the headphones 108 of the modular audio headphone device 100 may be secured. For example, a liner 218 configured to receive headphones 108 may be disposed in an inner portion of the hood 510A in a manner like that previously described with reference to the skull cap 210 of FIGS. 2 and 3. The headphones 108 may be disposed in the liner 218 on the first and second, opposing sides of the hood 510A.

In some embodiments, an emitted SPL profile of the headphones 108 over a range of frequencies when attached to (e.g., disposed in) the hood 510A may differ from an emitted SPL profile of the headphones 108 over the range of frequencies when attached to headband 110 (FIG. 1). Further, the different emitted SPL profiles may be selectively tuned to provide similar detectable SPL profiles over the range of frequencies to a user when the headphones 108 are used in either of the hood 510A and the headband 110.

Referring to FIG. 20, an interior side view of a helmet 510B (e.g., a snowboard, ski, or skateboard helmet) is shown. The helmet 510B is configured such that the headphones 108 may be secured within the helmet 510B. For example, a liner 218 configured to receive headphones 108 may be disposed in an inner portion of the helmet 510B in a manner like that previously described with reference to the skull cap 210 of FIGS. 2 and 3. The headphones 108 may be disposed in the liner 218 on the first and second, opposing sides of the helmet 510B.

In some embodiments, an emitted SPL profile of the headphones 108 over a range of frequencies when attached to (e.g., disposed in) the helmet 510B may differ from an emitted SPL profile of the headphones 108 over the range of frequencies when attached to headband 110 (FIG. 1). Further, the different emitted SPL profiles may be selectively tuned to provide similar detectable SPL profiles over the range of frequencies to a user when the headphones 108 are used in either of the helmet 510B and the headband 110.

Referring to FIG. 21, a front view of a full face helmet 510C (e.g., a motorcycle helmet) is shown. The full face helmet 510C may be configured to allow the headphones 108 to be secured therein. For example, a liner 218 configured to receive headphones 108 may be disposed in an inner portion of the full face helmet 510C as previously described, and the headphones 108 may be secured within the liner 218.

In some embodiments, an emitted SPL profile of the headphones 108 over a range of frequencies when attached to (e.g., disposed in) the full face helmet 510C may differ from an emitted SPL profile of the headphones 108 over the range of frequencies when attached to headband 110 (FIG. 1). Further, the different emitted SPL profiles may be selectively tuned to provide similar detectable SPL profiles over the range of frequencies to a user when the headphones 108 are used in either of the full face helmet 510C and the headband 110.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventor.

What is claimed is:

1. A modular audio headphone device, comprising:

a first user-wearable accessory;

at least one headphone configured for releasable attachment to the first user-wearable accessory, the at least one headphone comprising:

a speaker; and a speaker housing coupled to the speaker and configured to form an acoustic cavity proximate at least a portion of the speaker;

wherein the at least one headphone is configured to provide a first emitted sound pressure level (SPL) profile over a range of frequencies when the at least one headphone is attached to the first user-wearable accessory, and to provide a different second emitted SPL profile over the range of frequencies when the at least one headphone is not attached to the first user-wearable accessory.

2. The modular audio headphone device of claim 1, wherein the first emitted SPL profile is tuned to provide a first detectable SPL profile over the range of frequencies to a user of the modular audio headphone device when the at least one headphone is attached to the first user-wearable accessory and worn by the user, and wherein the second emitted SPL profile is tuned to provide a second detectable SPL profile over the range of frequencies to the user of the modular audio headphone device when the at least one headphone is attached to a second user-wearable accessory and worn by the user, wherein the second detectable SPL profile is at least substantially similar to the first detectable SPL profile over the range of frequencies.

3. The modular audio headphone device of claim 2, wherein the second detectable SPL profile is within about 7 dB (SPL) per 1 mW of the first detectable SPL profile over the range of frequencies.

4. The modular audio headphone device of claim 3, wherein the second detectable SPL profile is within about 5 dB (SPL) per 1 mW of the first detectable SPL profile over the range of frequencies.

5. The modular audio headphone device of claim 4, wherein the second detectable SPL profile is within about 3 dB (SPL) per 1 mW of the first detectable SPL profile over the range of frequencies.

6. The modular audio headphone device of claim 1, wherein the range of frequencies extends from about 30 Hz to about 1,000 Hz.

7. The modular audio headphone device of claim 6, wherein the range of frequencies extends from about 45 Hz to about 500 Hz.

8. The modular audio headphone device of claim 7, wherein the range of frequencies extends from about 60 Hz to about 100 Hz.

9. The modular audio headphone device of claim 1, wherein the second emitted SPL profile is at least about 7 db (SPL) louder than the first emitted SPL profile at about 100 Hz.

10. The modular audio headphone device of claim 9, wherein the second emitted SPL profile is at least about 5 db (SPL) louder than the first emitted SPL profile at about 100 Hz.

11. The modular audio headphone device of claim 10, wherein the second emitted SPL profile is at least about 3 db (SPL) louder than the first emitted SPL profile at about 100 Hz.

12. The modular audio headphone device of claim 1, wherein the speaker housing comprises at least one port opening extending between the acoustic cavity and an exterior of the speaker housing.

13. The modular audio headphone device of claim 12, wherein the at least one port opening has a first cross-sectional area when the at least one headphone is attached to the first user-wearable accessory and has a different second cross-sectional area when the at least one headphone is not attached to the first user-wearable accessory.

14. The modular audio headphone device of claim 13, wherein the second cross-sectional area is larger than the first cross-sectional area.

15. The modular audio headphone device of claim 14, wherein the first user-wearable accessory comprises a headband, the headband comprising at least one surface configured to cover at least a portion of the at least one port opening when the at least one headphone is attached to the headband.

16. The modular audio headphone device of claim 15, wherein the at least one surface of the headband is configured to cover only a portion of the at least one port opening when the at least one headphone is attached to the headband.

17. The modular audio headphone device of claim 1, wherein the first user-wearable accessory is selected from the group consisting of a headband, a skull cap, a helmet, and a hood.

18. The modular audio headphone device of claim 1, wherein the first user-wearable accessory comprises a headband.

19. The modular audio headphone device of claim 1, wherein the at least one headphone comprises a switch, the switch configured to be automatically activated upon attachment or detachment of the at least one headphone and the first user-wearable accessory, the switch configured to adjust an electronic signal applied to the speaker upon activation of the switch.

20. A modular audio headphone device, comprising:

at least one headphone configured for releasable attachment to a first user-wearable accessory, the at least one headphone comprising:

a speaker; and a speaker housing coupled to the speaker;

a first ear pad configured for attachment to the at least one headphone; and a second ear pad configured for attachment to the at least one headphone, the second ear pad different from the first ear pad;

wherein the first ear pad is configured to attenuate an emitted SPL profile emitted by the at least one headphone over a range of frequencies to provide a first detectable SPL profile over the range of frequencies to a user of the modular audio headphone device when the first ear pad is attached to the at least one headphone and the at least one headphone is attached to the first user-wearable accessory worn by the user;

wherein the second ear pad is configured to attenuate the emitted SPL profile emitted by the at least one headphone over the range of frequencies to provide a second detectable SPL profile over the range of frequencies to the user of the modular audio headphone device when the second ear pad is attached to the at least one headphone and the at least one headphone is attached to a second user-wearable accessory worn by the user; and wherein the second detectable SPL profile is at least substantially similar to the first detectable SPL profile over the range of frequencies.

* * * * *